US006612651B1

(12) United States Patent
Garland

(10) Patent No.: US 6,612,651 B1
(45) Date of Patent: Sep. 2, 2003

(54) LINKAGE MECHANISM FOR A MOTION CHAIR

(75) Inventor: Thomas A. Garland, Bradenton, FL (US)

(73) Assignee: Motion Technology, LLC, Bradenton, FL (US)

( * ) Notice: Subject to any disclaimer, the term of this patent is extended or adjusted under 35 U.S.C. 154(b) by 0 days.

(21) Appl. No.: 09/910,200

(22) Filed: Jul. 20, 2001

Related U.S. Application Data

(63) Continuation-in-part of application No. 09/173,252, filed on Oct. 14, 1998, now Pat. No. 6,318,803.

(60) Provisional application No. 60/219,542, filed on Jul. 20, 2000.

(51) Int. Cl.[7] ..... A47C 1/02

(52) U.S. Cl. ..... 297/344.11; 248/133; 297/259.2; 297/270.2; 297/281

(58) Field of Search ..... 297/344.11, 281, 297/258.1, 259.1, 260.2, 259.2, 246, 247, 270.1, 270.2, 270.3, 271.1, 272.2, 282, 273, DIG. 7; 5/127, 129; 248/133, 144, 398; 74/106

(56) References Cited

U.S. PATENT DOCUMENTS

| | | | | |
|---|---|---|---|---|
| 869,122 A | * | 10/1907 | Witte | |
| 1,212,675 A | | 1/1917 | Pettyjohn | |
| 2,044,862 A | | 6/1936 | Smith et al. | 5/124 |
| 2,270,172 A | * | 1/1942 | Ruegger | |
| 2,674,386 A | * | 4/1954 | Larson | |
| 2,682,481 A | | 7/1954 | Lorenz | 155/61 |
| 3,758,156 A | | 9/1973 | Zawadzki | 297/260 |
| 4,536,029 A | | 8/1985 | Rogers | |
| 4,544,201 A | | 10/1985 | Rogers | |
| 4,640,546 A | | 2/1987 | Aguilar | |
| 4,700,920 A | | 10/1987 | Horn | |
| 4,775,184 A | | 10/1988 | Larkin | |
| 4,911,499 A | | 3/1990 | Meeker | |
| 5,244,252 A | * | 9/1993 | Serber | 297/216.19 |
| 5,280,996 A | | 1/1994 | Trent | |
| 5,558,397 A | | 9/1996 | Chang | |
| 5,618,016 A | | 4/1997 | Garland et al. | |
| 5,765,913 A | | 6/1998 | LaPointe et al. | |
| 6,106,062 A | | 8/2000 | Ambrose et al. | |
| 6,318,803 B1 | * | 11/2001 | Garland | 297/344.11 |

FOREIGN PATENT DOCUMENTS

| | | |
|---|---|---|
| DE | 19743902 A1 | 4/1998 |
| FR | 2118308 | 12/1970 |
| GB | 2171610 A1 | 3/1985 |

* cited by examiner

*Primary Examiner*—Peter M. Cuomo
*Assistant Examiner*—Stephen Vu
(74) *Attorney, Agent, or Firm*—Bromberg & Sunstein LLP

(57) ABSTRACT

An apparatus is provided for imparting substantially oscillatory horizontal motion to a subject. The apparatus has a translating support assembly, an oscillatory mechanism, and an actuator permitting the subject to apply a non-gravitational acceleration to the translating support assembly. The oscillatory mechanism has a linkage assembly with mounts offset in a plane transverse to the direction of motion so as to permit a large stroke of travel of the translating support assembly relative to a fixed support structure. Additionally, a locking mechanism is provided that is biased to preclude motion of the oscillatory mechanism in the absence of a substantial weight on the support assembly.

15 Claims, 25 Drawing Sheets

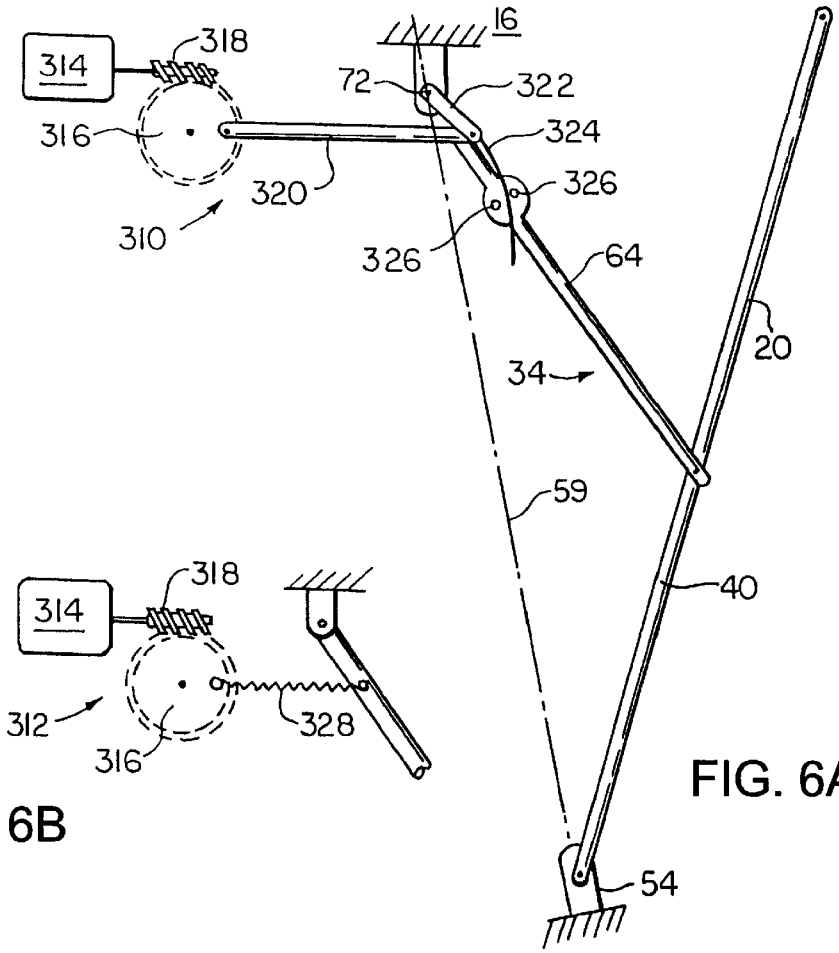
FIG. 6A
FIG. 6B
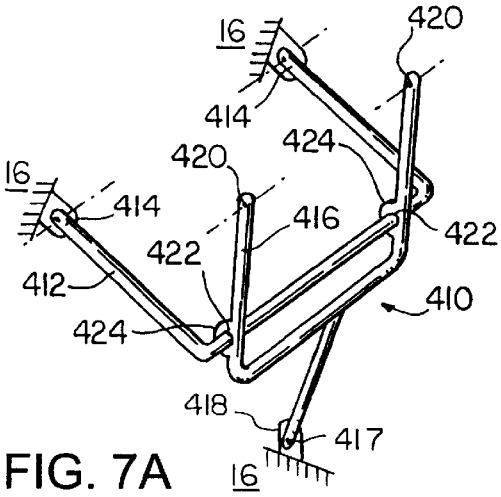
FIG. 7A
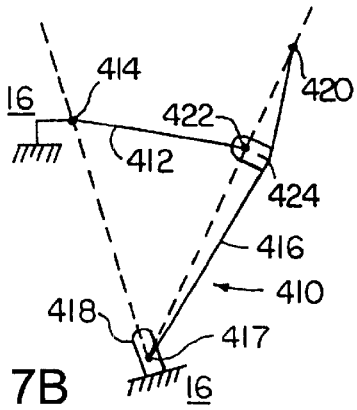
FIG. 7B

LINKAGE MECHANISM FOR A MOTION CHAIR

This application is a continuation-in-part of the U.S. patent application, Ser. No. 09/173,252 filed Oct. 14, 1998, now U.S. Pat. No. 6,318,803, and additionally, claims priority from U.S. Provisional Applications, Serial No. 60/219,542, filed Jul. 20, 2000, both of which applications are incorporated herein by reference.

TECHNICAL FIELD

The present invention relates generally to furniture for imparting oscillatory motion to a subject, and more particularly to furniture having an actuator mechanism for control of the oscillatory motion by the subject.

BACKGROUND OF THE INVENTION

Various designs of furniture for supporting one or more persons, typically in either a seated or reclining position, and, additionally, for providing some motion relative to the ground or floor of an assembly that supports the person, are known in the art. Such furniture, as broadly described and as referred to herein as "motion chairs," includes such common items as rocking chairs and gliders. Additional devices that are fixed in position and both support and provide for motion of a person fall into the category of juvenile products or physical exercise equipment. In some cases, motion of the supporting assembly is relative to a base component of the furniture item, where the base component is supported by the floor or ground. In the present description and in any appended claims, the term "floor" will be used to encompass any surface upon which an item of furniture may rest, and may include, without limitation, the ground.

One means known for providing for motion of a support assembly relative to a base of an item of furniture utilizes linkage assemblies which produce an arc-like path and was previously discussed in U.S. Pat. No. 5,618,016 (the "'016 patent"), which patent is incorporated herein by reference.

Furniture items, such as those surveyed in the foregoing paragraphs, that provide for motion of one or more supported persons, typically require either:

(1) that a force be exerted on the supporting assembly with respect to a surface external to the furniture; or (2) that an occupant displace his center of gravity substantially to cause or sustain oscillatory motion.

Thus, for example, an ordinary rocking chair is driven by action of the feet of the occupant against the floor, or, in some cases, against an ottoman. In order to maintain a continuous motion such as an oscillatory rocking, the occupant's feet must either be kept on the floor or periodically placed there to drive the motion. In a common suspended swing or its variants, the occupant must exert enough force to substantially shift his center of gravity with respect to the equilibrium point of the motion. In either case, braking the motion of the support similarly requires exertion of a force with respect to a stationary surface or substantial motion of the center of gravity of the occupant.

SUMMARY OF THE INVENTION

In accordance with a preferred embodiment of the present invention, there is provided an apparatus for imparting substantially oscillatory motion to a subject, wherein the apparatus has a support assembly and an oscillatory mechanism that defines a path of motion of the support assembly, as well as a lock mechanism having a first position to preclude motion of the oscillatory mechanism and a second position to permit motion of the oscillatory mechanism. The lock mechanism is biased to assume the first position in the absence of a substantial weight present on the support assembly. In further embodiments, the lock mechanism is configured to assume the second position only in the presence of a substantial weight on the support assembly and only if a manual release has been activated.

In accordance with other embodiments of the present invention, an apparatus is provided for imparting substantially oscillatory motion to a subject, the apparatus having a support assembly for supporting the subject and an oscillatory mechanism that defines a path of motion of the support assembly. Additionally, the apparatus has an actuator, including a manipulandum with a curved profile and protruding through an opening, permitting the subject while supported by the support assembly to apply a non-gravitational acceleration to the support assembly.

In accordance with alternate embodiments of the invention, the curved profile of the manipulandum may be arcuate, the opening may be a slot, and the manipulandum may be a disc-shaped member, and, more particularly, a member with a perimeter of approximately 180 degrees and a chord corresponding approximately to a diameter of the disc. The manipulandum may be coupled by a linkage to the oscillatory mechanism.

In accordance with further embodiments of the invention, a linkage assembly is provided of the type including a first link connected at a first point to a translation mechanism attached to a support structure, the translation mechanism arranged to allow the first point of the first link to translate along a substantially straight axis and a second link pivotally connected at a first point to the support structure and pivotally connected to the first link at a second point such that a second point of the first link oscillates. An improvement to the linkage assembly has first and second offset mounts attached at corresponding locations to the first and second links respectively and overlapping one another. The mounts are configured so that the second link is pivotally connected to the first link at a pivot point about a pivot axis located in a region of overlap of the offset mounts.

In accordance with yet further embodiments of the invention, an improvement is provided to a linkage assembly of the type including a first link connected at a first point to a translation mechanism attached to a support structure, the translation mechanism arranged to allow the first point of the first link to translate along a substantially straight axis and a second link pivotally connected at a first point to the support structure and pivotally connected to the first link at a second point that link travels on an arc of substantially constant finite radius and the first link pivots with respect to the second link. The improvement, in accordance with the invention, has first and second offset mounts attached at corresponding locations to the first and second links respectively and overlapping one another, the mounts configured so that the second link is pivotally connected to the first link at a pivot point about a pivot axis located in a region of overlap of the offset mounts.

In either of the foregoing improved linkage assemblies, the first link may be disposed so that the pivot point is located approximately collinearly with the first and second points of the first link. The second link may be attachable at a third point to a second translation mechanism, the second translation mechanism being attached to a support, and the first link may be attachable to the support at the second point, with the second link disposed so that the pivot point is located approximately collinearly with the first and third points of the second link.

In accordance with yet further embodiments of the invention, the improved linkage assemblies may have a second corresponding pair of first and second links spaced apart from the first and second links, a first cross member coupled between the second link and the corresponding second link and attached in each instance near the first point of each such second link, and a second cross member coupled between the first link and the corresponding first link and attached in each instance near the second point of each such first link.

In accordance with other embodiments of the invention, an apparatus is provided for imparting substantially oscillatory motion to a subject, where the apparatus has a support assembly for supporting the subject and an oscillatory mechanism that defines a path of motion of the support assembly. The oscillatory mechanism has a post the base of which is coupled to a fixed frame, as well as a first link having a first end pivotably coupled to a point on the fixed frame and a second end pivotably coupled to provide sliding motion relative to the support assembly. Additionally, the oscillatory mechanism has a second link having a first end pivotably coupled to the support assembly and a second end coupled to provide sliding motion collinearly with the post.

In accordance with still another embodiment of the invention, there is provided an apparatus for imparting substantially oscillatory motion to a subject, the apparatus having a support assembly for supporting the subject and an oscillatory mechanism. The support assembly defines forward and rearward directions, and the support assembly and subject are together characterized by a center of gravity. The oscillatory mechanism defines a path of motion of the support assembly, where the path of motion has a lowest point horizontally displaced rearward with respect to a centerline of the support assembly.

BRIEF DESCRIPTION OF THE DRAWINGS

The invention will be more readily understood by reference to the following description, taken with the accompanying drawings, in which:

FIGS. 6*a* and 6*b* are side schematic views of mechanisms for driving a linkage assembly, such as that of FIGS. 3*a*, 3*b*, and 3*c*, in accordance with embodiments of the present invention;

FIGS. 7*a* and 7*b* are perspective and side schematic views of a linkage assembly in accordance with alternate embodiments of the present invention;

FIGS. 10*a* and 10*b* show another embodiment of the present invention wherein a handwheel 300 replaces handle 284 of FIG. 3*d*, while

DETAILED DESCRIPTION OF SPECIFIC EMBODIMENTS

Oscillatory motion, especially at a cadence at, or slower than, that of a resting heart rate, may be soothing to a person, and, more particularly, oscillation of a support surface may be advantageously employed in both seating products and beds.

Figure 1:
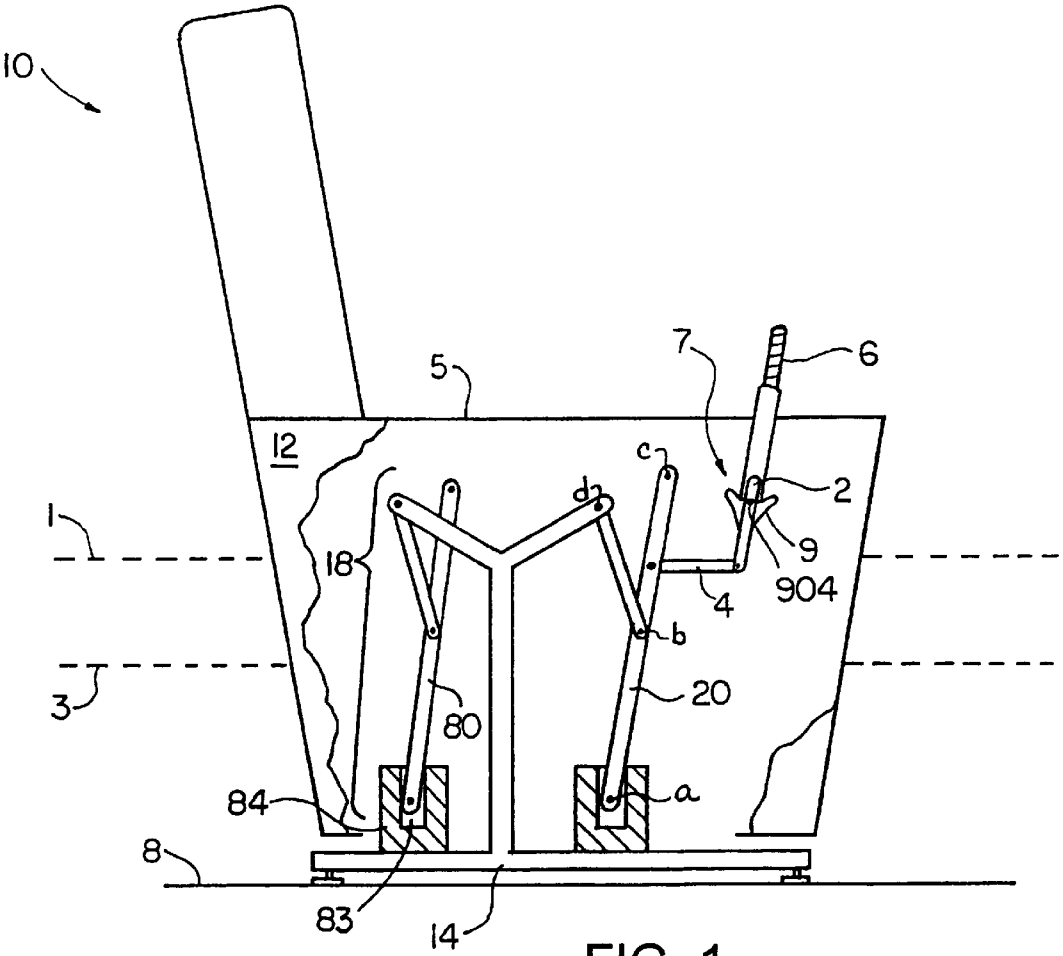
FIG. 1 is a side view of an oscillating seat showing a linkage mechanism and a remote handle in accordance with a preferred embodiment of the present invention.

Referring to FIG. 1, an oscillating seat is shown and designated generally by numeral 10. Oscillating seat 10, which is an example of a moving chair, includes a chair 12 which serves as a support surface. A housing of chair 12 is cut away in this view, so as to expose a linkage assembly 18. Linkage assembly 18 may be advantageously disposed in a volume 11 (also referred to herein as an 'arm pocket') beneath the armrests 5, and, moreover, disposition of linkage assembly 18 substantially in volume 11 beneath armrests 5 may advantageously provide enhanced motion fore and aft and provide convenient access for attachment of actuators for control by the occupant of the motion of the seat, as further discussed below.

Linkage assembly 18 connects frame 14 to chair 12 and is described in detail below in connection with FIGS. 3*a*, 3*b*, and 3*c*. Oscillation of chair 12 refers to its substantially periodic motion in a fore-aft direction with respect to frame 14. The "stroke" of oscillatory motion is typically referred to a fiducial position (characterized below as the "midpoint") at, or near, the center of the fore-aft motion, while the total front-to-back motion is thus, typically, twice the length of the stroke as thus defined.

In the embodiment depicted in FIG. 1, links 20 and 80 of linkage assembly 18 are coupled to chair 12 and slide within slots 83 of slider 84 which is attached to frame 14. As links 20 and 80 translate fore and aft relative to frame 14, so also does chair 12. More generally, the scope of the present invention encompasses an apparatus, which may be a piece of furniture, and is described in terms of oscillating seat 10 which is shown as an example only, and without limitation. Basic components of the piece of furniture which is the subject of preferred embodiments of the present invention include a moving support assembly, of which chair 12 is an example, which supports a human subject (not shown) and which undergoes motion relative to a component of the piece of furniture, referred to as a "base," of which frame 14 is an example. Chair 12 has a seating surface (not shown), having an upper surface generally coinciding with the dashed line designated by numeral 1, and a lower surface generally coinciding with the dashed line designated by numeral 3. Base 14 is supported by floor 8, and may rest on casters or otherwise. The motion executed by the support assembly may have both horizontal and vertical components, with the horizontal component being in the fore-aft direction (as in the motion of a rocker or a glider), or in a lateral direction (as in the motion of a hammock), or in any combination of the two directions. The vertical component of the motion may be zero or substantially zero. Moving portions of the support assembly and the oscillatory mechanism, along with the body of the supported person supported may be referred to collectively as a carriage assembly and may be characterized by a center of gravity.

It should be noted that linkage assembly 18 is shown by way of example, and without limitation, whereas the coupling between the support assembly 12 and base 14 is more generally an oscillatory mechanism of any sort known to persons skilled in the mechanical arts, and may include the motion of wheels in a track or any suspension means or any other coupling mechanism.

The horizontal component of the motion of the support assembly may be characterized as having a midpoint, as described below, and any vertical component of the motion may be constrained to be bilaterally symmetrical over some portion of the travel with respect to a reference point defined along the path of travel.

Also shown in FIG. 1 is an actuator 6, which may, by way of example, be a handle, which allows the seated subject to drive mechanism 18, and, through the drive mechanism, support assembly 12, into oscillatory motion Actuator 6 may also be a foot pedal, as described below, or any other mechanism for allowing the subject to excite or otherwise control the oscillatory motion of the support assembly. Actuator 6 may be coupled to drive mechanism 18 either directly or via a connector 4, and may be advantageously disposed in the space above upper seat surface 1. However actuator 6 need not be coupled to the drive mechanism. For example, actuator 6 may include handles attached to fixed base 14. Actuator 6 is shown in an embodiment in which it pivots about pivot 2, and also provides for braking and locking the support assembly by means of braking assembly 7 as described in detail below with reference to FIGS. 9*a* and 9*b*.

Figure 2A:
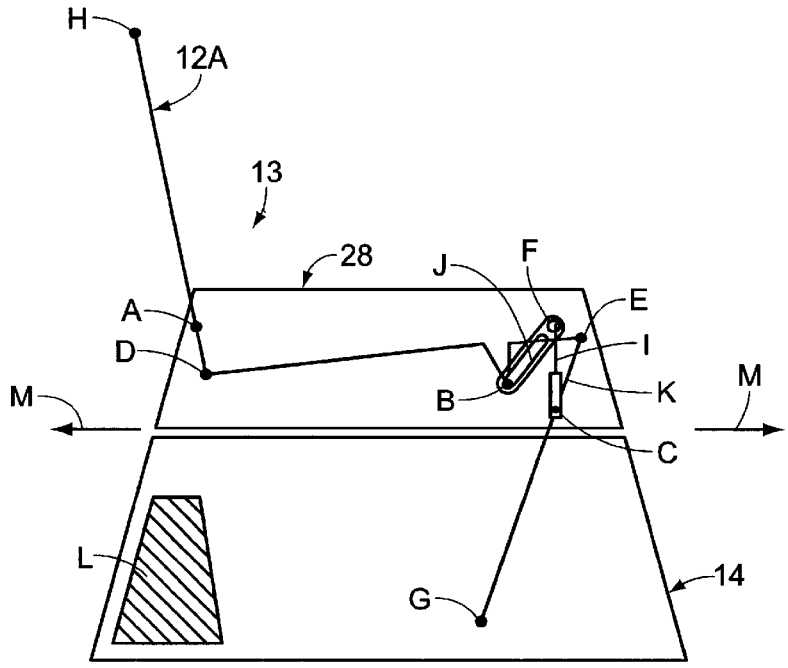
FIGS. 2*a* and 2*b* are side schematic views of a reclining seat assembly in accordance with further embodiments of the present invention.

One of the various configurations that may be assumed by the seat assembly within the scope of the present invention is that of a recliner, as now described with reference to FIGS. 2*a* and 2*b*. An alternate reclining seat assembly is indicated generally by numeral 13. The reference numerals for the base 14 and chair support 28 are the same as previously described, with chair support 28 translating fore and aft via a linkage assembly as previously described. A reclining seat portion is designated generally by numeral 12A and comprises a back rest portion defined between points H and D, a seat portion defined between points D and E, and a foot rest portion defined between points E and G. Points D and E comprise pivot connections for rotation of the respective seat portions. The assembly further comprises a sliding piston pivot link I and a cylinder K. The back rest portion HD is pivotally mounted to the chair support 28 at point A such that movement of point H rearwardly forces movement of point D forwardly. Pivot link I has a first end point F pivotally connected to chair support 28. Seat portion DE is connected at point B to a slot J within seat support 28. Pivot connection F is a single point pivot while B can slide within the slot J. Piston I and cylinder K are pivotally connected between point F and another pivot point C on the foot rest portion KG.

In use, the reclining seat assembly 13 is usually positioned in a normal upright position (FIG. 2*a*) wherein the back rest portion HD is generally upright and the foot rest portion EG is folded beneath the front portion of the base 14. In this regard, it is pointed out that the reclining assembly 13 occupies a minimum of space beneath the chair support 28 and thus advantageously does not interfere in any way with the linkage assembly which may be located beneath the chair support 28. In particular, the reclining mechanism described with reference to FIG. 2*a* may be employed in conjunction with various mechanisms known in the art for providing for motion of a support assembly. Such mechanisms include, for example, and without limitation, the rocking mechanism described in U.S. Pat. No. 4,536,029, which is incorporated herein by reference. Correspondingly, various other mechanisms known in the art for providing a reclining seat assembly may be used in conjunction with various linkages described with reference to FIG. 1 and otherwise in the present description. Other means of configuring a reclining support to accomplish the stated objective of maintaining a substantially fixed center of gravity are apparent to persons skilled in the mechanical arts and are within the scope of the present invention as claimed in the appended claims. An advantage of the reclining mechanism of FIG. 2*a* is that a cross-brace L can be used in the rear to accommodate movement of the foot rest portion EG in the front of the assembly.

Figure 2B:
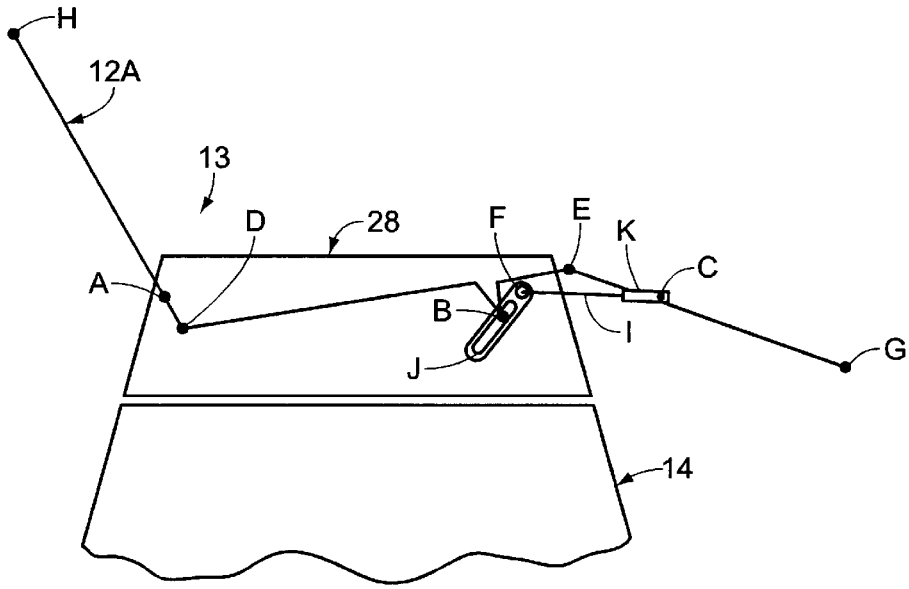

Referring now to FIG. 2*b*, reclining seat 13 is movable from the normal upright position (FIG. 2*a*) to a reclined position simply by pressing backwardly on the back rest portion HD. As stated previously, movement of point H rearwardly forces points D and E, and thus the whole seat portion, in a forward direction. As seat portion DE moves forwardly, point B slides within the slot J to incline the front portion of the seat DE upwardly. Meanwhile, forward and upward movement of point E forces the foot rest portion EG to pivot about point E, while the piston link K extends to force the foot rest portion EG to substantially horizontal position for resting of the feet. Accordingly, it can be seen that chair support 28 can translate fore and aft along lines M relative to the base 14, while the chair 12A can remain upright (FIG. 2*a*), or recline rearwardly (FIG. 2*b*). By translation forward as the seat reclines, the center of gravity of the support assembly, including the weight of the supported person, may be advantageously maintained substantially at the midpoint of the horizontal stroke of the oscillatory motion of the support assembly. Thus, a large range of horizontal travel is preserved that is of substantially symmetrical extent between any limits to motion in the fore and aft directions.

Figure 3A:
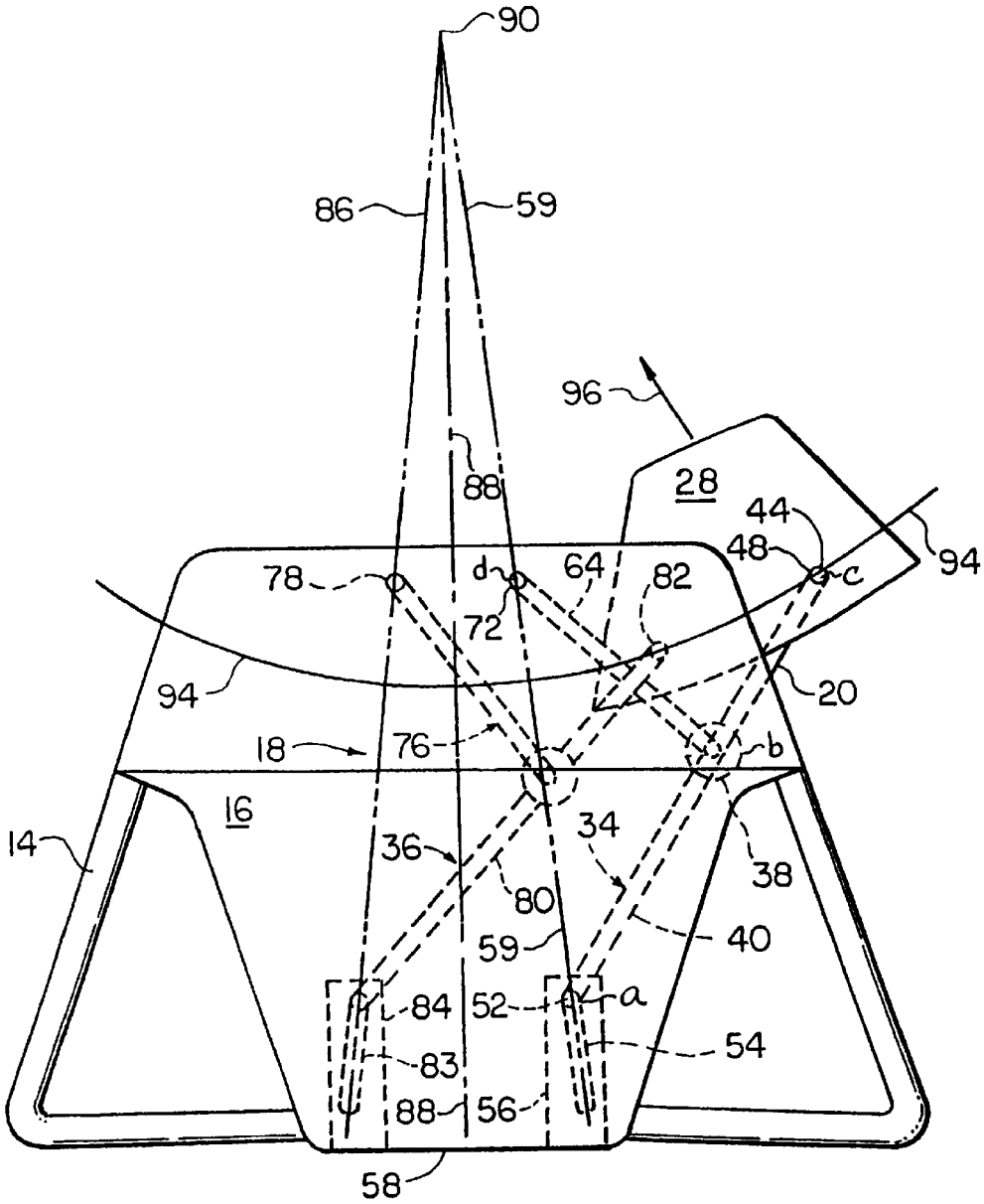
FIGS. 3*a*, 3*b*, and 3*c* are side, front, and schematic side views, respectively, of a linkage assembly of an oscillating seat in accordance with an embodiment of the present invention.
Figure 3E:
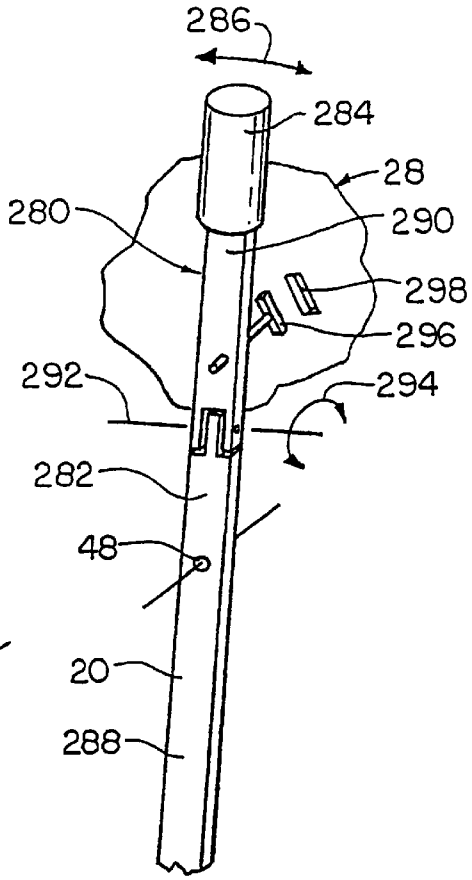
FIG. 3*e* is a fragmentary perspective view showing a braking and locking mechanism for preventing movement of the oscillating seat relative to the support structure.
Figure 3C:
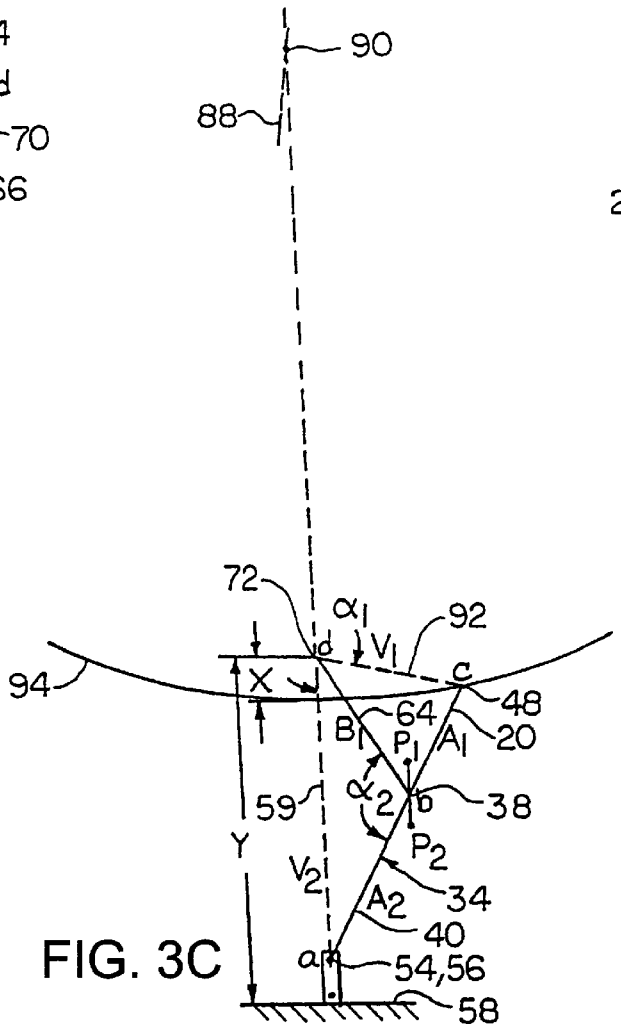
Figure 3B:
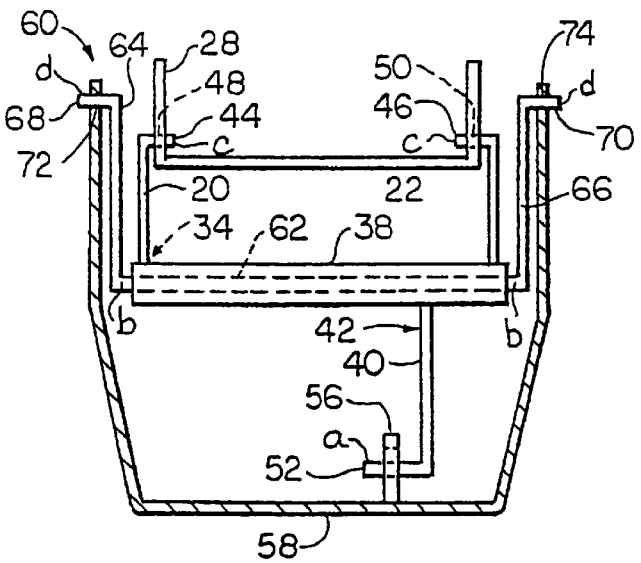

With reference to FIGS. 3*a*, 3*b*, and 3*c*, in accordance with various embodiments of the invention, linkage assembly 18 includes a fore linkage 34 and an aft linkage 36.

In fore linkage 34, links 20 and 22 rigidly attach at the top side of a tubular sleeve 38, and a link 40 rigidly attaches at the bottom side of sleeve 38. Links 20, 22, 40, which may be formed from steel wire or rod, are all generally collinear. Links 20 and 40 together represent a first link of a linkage assembly. Together, sleeve 38 and links 20, 22, 40 form a Y-shaped yoke 42. The free ends 44, 46 of links 20, 22 are bent 90 degrees and inserted into holes 48, 50 in the sides of chair support 28. Holes 48, 50 are sized to allow links 20, 22 to pivot with respect to support 28. The free end 52 of link 40 is likewise bent 90 degrees and inserted into a slot 54 in a slider 56 which serves as a translation mechanism and attached to the floor 58 of housing 16. Slot 54, which extends along an axis 59, is sized to allow link 40 to slide and pivot with respect to slider 56.

Fore linkage 34 also includes a U-shaped yoke 60 having a horizontal cross-member 62 extending through the hollow interior of sleeve 38. Two parallel links 64, 66 project perpendicularly from opposite ends of horizontal cross-member 62. Link 64 represents a second link of the linkage assembly which includes links 20 and 40 (together representing the first link). The free ends 68, 70 of links 64, 66 are bent 90 degrees and inserted into holes 72, 74 in the top of housing 16. Cross-member 62 and links 64, 66 may be formed from, e.g., a unitary section of steel wire or rod. The hollow interior of sleeve 38 is sized to allow U-shaped yoke 60 to pivot with respect to sleeve 38. Holes 72, 74 are sized to allow links 64, 66 to pivot with respect to housing 16.

Aft linkage 36 is substantially identical to fore linkage 34. The top of a U-shaped yoke 76 in aft linkage 36 is inserted into holes 78 in the top of housing 16 (only one hole 78 shown), allowing yoke 76 to pivot with respect to housing 16. The top of a Y-shaped yoke 80 (to which U-shaped yoke 76 pivotally attaches) in aft linkage 36 is inserted into holes 82 in the sides of support 28 (only one hole 82 shown), allowing yoke 80 to pivot with respect to support 28. Holes 82 are aft of holes 48, 50. The bottom of Y-shaped yoke 80 is inserted into a slot 83 of a slider 84 attached to the floor 58 of housing 16. Slot 83 extends along an axis 86. Slider 84 allows Y-shaped yoke 80 to pivot and slide with respect to housing 16. Axis 59 of slot 54 and axis 86 of slot 83 arc inclined towards one another, intersecting with a vertical axis 88 of linkage assembly 18 (i.e., the vertical axis centered between holes 72, 78) at an approximate center point 90 located well above housing 16. The selection of the inclinations of axes 59, 86 is discussed in further detail below. Because of the construction of linkage assembly 18, the weight of fore and aft linkages 34, 36 is, in most instances, sufficient to cause linkage assembly 18 to return to its center position, i.e., the rotational orientation where fore and aft linkages 34, 36 lie on axes 59, 86, respectively.

Holes 72, 78 in housing 16 also lie along axes 59, 86, respectively. Thus, the arrangement of links, pivots, and sliders of each of the fore and aft linkages 34, 36 can be schematically represented as shown in FIG. 3*c*. $A_1$ and $A_2$ represent the respective lengths of links 20, 40, and B, represents the length of link 64. $V_1$, the distance along a line 92 extending from hole 72 (point d) to hole 48 (point c), varies with the orientation of the linkage, as does $V_2$, the distance along axis 59 from point d to the end of link 40 in slot 54 (point a). The junction of link 20 and link 40 defines point b.

Point d (holes 72, 74) of fore linkage 34 remains fixed with respect to housing 16 as the orientation of linkage 34 changes. Because of slot 54, the orientation of axis 59 also remains fixed with respect to housing 16.

A method for determining dimensions $A_1$, $A_2$, and $B_1$ of fore linkage 34 is described in the '016 patent. Other methods should also be apparent from the details set forth therein. The dimensions of aft linkage 36 are determined in the same manner.

Generally, the external dimensions of rocker seat 10 are chosen in accordance with ergonomic, manufacturing, marketing, shipping, and other considerations, and linkage assembly 18 is designed to fit within the available space. The location of point d (holes 72, 74) is usually selected to provide the maximum clearance between point d and the floor 58 of housing 16.

The desired path of travel of point c is next chosen. In particular, approximate center 90 (which lies along vertical axis 88) and a radius are selected to define a constant-radius path 94. The radius of path 94 may range from zero to infinity. Moreover, although center 90 in FIGS. 2*a* and 2*c* lies above path 94, it may instead be located below the desired path. While it may not precisely follow path 94, point c (holes 48, 50) lies generally on or near path 94 throughout its range of travel (note that hole 82, which defines point c for aft linkage 36, also lies on or near path 94 throughout its range of travel). Approximate center 90 and point d together determine the orientation of inclined axis 59. To avoid interference between free end 52 of link 40 and the bottom of slot 54 as fore linkage 34 rotates under point d and aligns with axis 59, the sum of $B_1$ and $A_2$ should not exceed $Y_1$, the distance along axis 59 between point d and the floor 58 of housing 16. Generally, the sum of $B_1$ and $A_2$ will approximately equal $Y_1$ the available clearance distance.

Once path 94 has been selected, X, the distance between point d and path 94 along axis 59, is then determined. For convention, X is positive if d lies above path 94, and negative if d lies below path 94. The maximum desired forward "stroke" (i.e., the maximum forward limit of travel of point c along path 94), is then chosen. With point c at it maximum stroke position, point a is at the top of slot 54.

With point c at its maximum stroke position (as shown in FIG. 3*c*), to graphically determine the location of point b, an arc of radius $r_1$ is swept from point c, and an arc of radius $r_1$ plus X is swept from point d. The intersection of these two arcs defines point $P_1$. Next, an arc of radius $r_2$ is swept from point c, and an arc of radius $r_2$ plus X is swept from point d to similarly define point $P_2$. A line drawn through points $P_1$ and $P_2$ intersects fore linkage 34 at point b. By selecting point b in this manner, $B_1$ equals $A_1$ Plus X. Thus, when fore linkage 34 lies along inclined axis 59, point c lies on path 94. Note that because of the construction of fore linkage 34, the distance between point a and point c will generally be greater than the distance between point b and point d.

Because of the construction of fore linkage 34, it is possible to describe the location of point c as a function of $V_1$ and the angle $\alpha_1$ between line 92 and axis 59. From the law of cosines, it follows that:

$$(A_1+A_2)^2 32\ V_1^2+V_2^2-2V_1V_2\cos(\alpha_1). \quad (1)$$

And, since $\alpha_2$, the angle between link 40 and link 64, and $\alpha_3$, the angle between link 20 and link 64, are supplementary angles (and thus $\cos(\alpha_2)=-\cos(\alpha_3)$), it similarly follows from the law of cosines that:

$$V_2^2 - \frac{A_2}{A_1}(A_1^2 + B_1^2 - V_1^2) + A_2^2 B_1^2. \quad (2)$$

As discussed above, generally, $B_1$ equals $A_1$ plus X, and $B_1$ plus $A_2$ equals Y. Thus, using the values of $A_1$, $A_2$, and $B_1$ determined above, equations (1) and (2) can be solved simultaneously to determine $V_1$ as a function of $\alpha_1$. Further, the lengths of slots 54, 83 may be determined by calculating the difference between $V_2$(max) and $V_2$(min), the maximum and minimum values, respectively, of $V_2$ for each linkage 34, 36 as holes 44, 82 move along their respective arcs.

As noted above, the axes 59, 86 of slots 54, 83 of sliders 56, 84 are inclined towards one another to intersect at approximate center 90. With axes 59, 86 inclined in this manner, support 28, and thus also chair 12, pivot as point c for each linkage 34, 36 (holes 48, 50, 82) travels on or near arc 94. In particular, a normal vector 96 projecting from the top of support 28 remains directed toward or near approximate center 90 as linkage assembly 18 rotates and slides about its various axes, much as if support 28 were a pendulum suspended from center 90. Accordingly, a person seated in chair 12 experiences a sensation similar to that of being swung from an overhead linkage hinged at approximate center 90 (a virtual pivot), without the need for such a cumbersome overhead linkage.

Alternatively, the motion of chair 12 may be modified by varying the relative inclinations of axes 59, 86, so they no longer point at approximate center 90. For instance, keeping holes 72, 78 in the locations shown in FIG. 3*a*, sliders 56, 84 could be moved toward vertical axis 88 until they lie directly under holes 72, 78, respectively. In this configuration, axes 59, 86 of slots 54, 83 would be parallel, and holes 44, 82 (and thus also support 28 and chair 12) would remain generally horizontal as support 28 moves through its range of travel.

If space constraints, packaging or aesthetic concerns, structural support issues, or other considerations so dictate, linkage assembly 18 may be inverted, so that point d is located below point a (i.e., point d is at a point of lower gravitational potential energy than point a).

Moreover, pivot joints may be preferable to sliders in some applications. If so, sliders 56, 84 may be replaced with a link, pivoted at one end with respect to housing 16 and at the other end with respect to free end 52 of link 40, that is long enough to provide substantially straight motion at free end 52. Thus, each of these alternatives, the slider and the long link arrangement, comprises a translation mechanism or a translation means that allows free end 52 to translate along a substantially straight axis.

Additionally, the period of oscillation may be determined, either in design of the oscillating seat or by the occupant of the seat. One method for modifying the period of oscillation, given as an example and without limitation, is described with reference to FIG. 3*a*. The position of pivot d may be moved laterally with respect to the position of slider a, with positions closer to vertical alignment corresponding to slower oscillation. A period of oscillation may be chosen to provide relaxation to the occupant, in accordance with a specified functional relationship to the resting heart rate of the occupant. In particular, the oscillation of the support assembly, which need not be truly periodic within the scope of the present invention, may advantageously be approximately equal to, or slower than, the resting heart rate of the occupant.

Figure 4B:
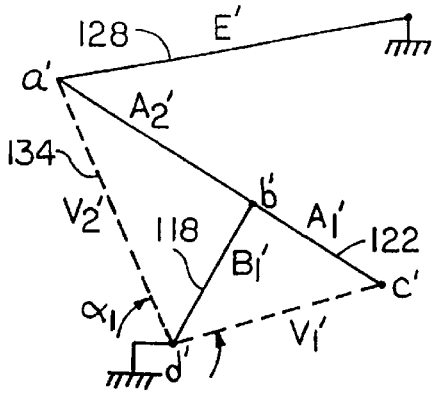
FIGS. 4*a* and 4*b* are side and schematic views, respectively, of another embodiment of a linkage assembly for a moving chair.
Figure 4A:
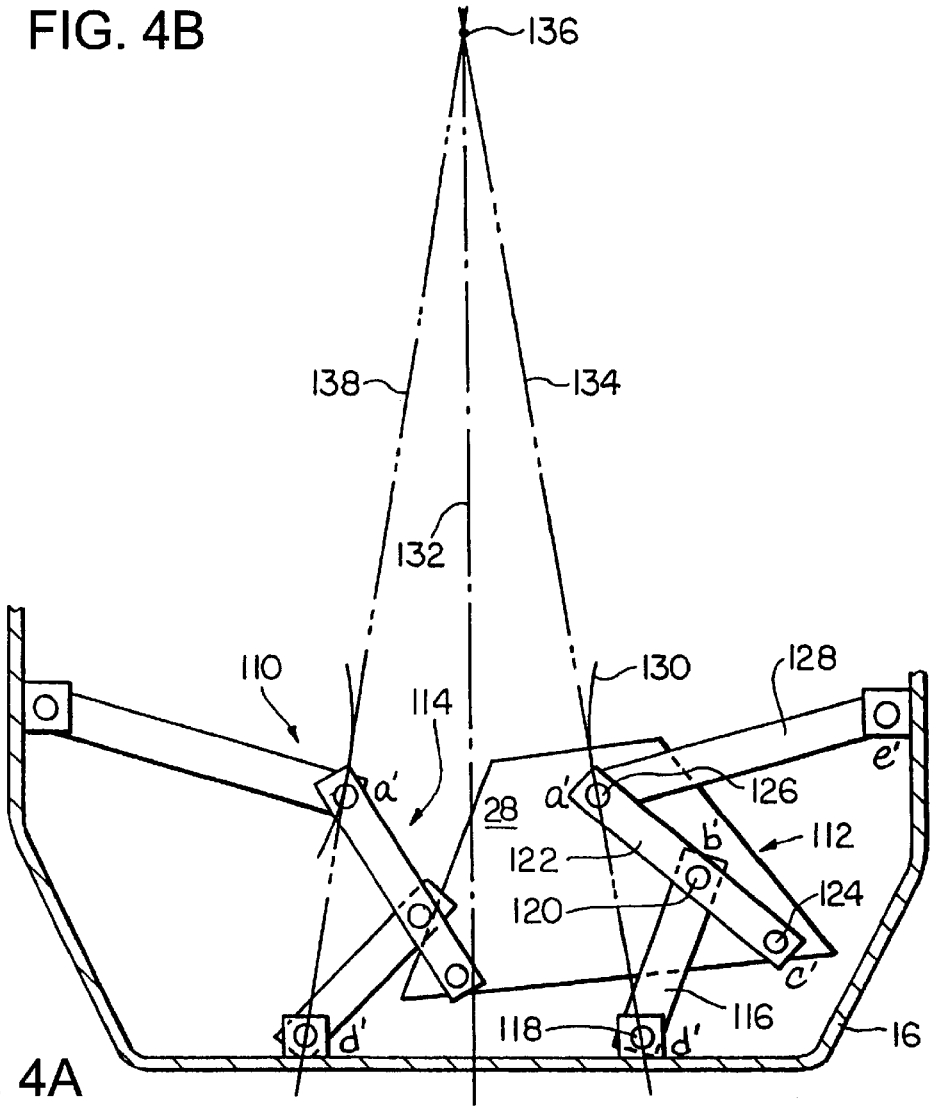

Both of these features are present in the embodiment shown in FIGS. 4*a* and 4*b*. Linkage assembly 110 includes a fore linkage 112 and a substantially identical aft linkage 114. (Only one side of each linkage 112, 114 is shown in FIG. 4*a*. The side not shown is adjacent to linkage assembly 110, and is essentially a mirror image of the depicted side.) A link 116 in fore linkage 112 pivotally attaches at one end 118 (point d') to housing 16, and at the other end 120 (point b') to the middle region of a link 122. Link 122 pivotally attaches at one end 124 (point c') to chair support 28, and at the other end 126 (point a') to a long link 128 pivotally attached at point e' to housing 16 with this arrangement, long link 128 represents a third link pivotally connected at a first point to a support structure (housing 16) and pivotally connected at a second point to a first point of a first link 122. Thus, point a' moves through an arcuate path 130 determined by the location of point e', and the length of link 128. As explained above, link 128 is sufficiently long that path 130 is substantially straight, and thus approximates the behavior of a slider.

When chair support 28 is centered on vertical axis 132 of linkage assembly 110 (i.e., when chair support 28 is at the midpoint of its travel) (not shown), linkages 116, 122 lie along an inclined axis 134 defined by points a' and d'. Inclined axis 134 intersects vertical axis 132 at an approximate center point 136. In addition, when support 28 is centered in this manner, link 128 lies perpendicular to inclined axis 134, so that path 130 is tangent to inclined axis 134 at the point of perpendicularity. An inclined axis 138 defined by points a' and d' of aft linkage 114 similarly intersects approximate center point 136. The sizes of the various links in the fore and aft linkages 112, 114, as well as the locations of points a', b', c' and d', are selected as described above in connection with FIGS. 2*a*, 2*b*, and 2*c*.

As with linkage 18, support 28 pivots as linkage assembly 110 rotates, much as if support 28 were a pendulum suspended from center 136. Because of the construction of linkage assembly 110, if chair support 28 is unloaded (e.g., if chair 12 is not attached to support 28), the weight of fore and aft linkages 112, 114 may be sufficient to cause linkage assembly 110 to rotate to either its fore or its aft limit of travel. If this is the case, loading chair support 28 will typically cause linkage assembly 110 to return to its center position (i.e., the rotational orientation where fore and aft linkages 112, 114 lie on axes 134, 138, respectively).

As shown in FIGS. 5*a*, 5*b*, 5*c*, 5*d*, and 5*e*, another embodiment of a linkage assembly for a moving chair employs two pair of adjacent, and substantially identical, linkages 210, 211. A link 212 in linkage 210 connects at one end 214 (point a") to a slider 216 attached to housing 16. The other end 218 of link 212 (point c") pivotally attaches to a link 220 extending perpendicularly from the base of chair support 28. Another link 222 pivotally attaches at one end 224 (point d") to housing 16, and at the other end 223 (point f") to a slider 228 at the end 230 of link 220. The axis 232 of slider 216 extends through point d" (pivot 224).

Similar to the embodiment shown in FIGS. 4*a* and 4*b*, linkage assembly 210 could be inverted, and slider 216 could be replaced with a long link arm pivoted at both ends.

The dimensions $A_1$", $A_2$", and $B_1$" of linkage assembly 210, as well as the locations of points a", b", c", and d", are selected as described above in connection with FIGS. 3*a*, 3*b*, and 3*c*. Note that in linkage 210, point d" (pivot 224) lies on arc 238. Thus, $B_1$" equals $A_1$,". The length $B_2$" between points b" and f" as well as the length $C_1$" between points c" and f", are chosen so that the axis 234 of slider 228 intersects the axis 232 of slider 216 at or near the approximate center 236 of the arc 238 through which point c" (pivot 218) sweeps. Thus, link 220 and the portion of link 222 extending between point b" and point f" comprise a load control mechanism, keeping support 28 properly oriented as linkage assembly 210 rotates, much as the fore and aft linkages in linkages assemblies 18, 110 cooperate to keep support 28 oriented. As with linkage assemblies 18, 110, support 28 pivots as linkage 210 rotates, much as if support 28 were a pendulum suspended from center 236.

Figure 5B:
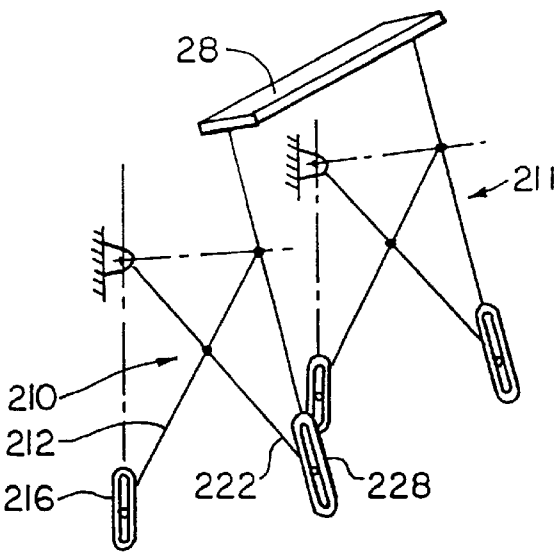
FIGS. 5*a*, 5*b*, and 5*c* are side, schematic perspective, and schematic side views, respectively, of yet another linkage assembly in accordance with a further embodiment of the oscillating seat invention.
Figure 5A:
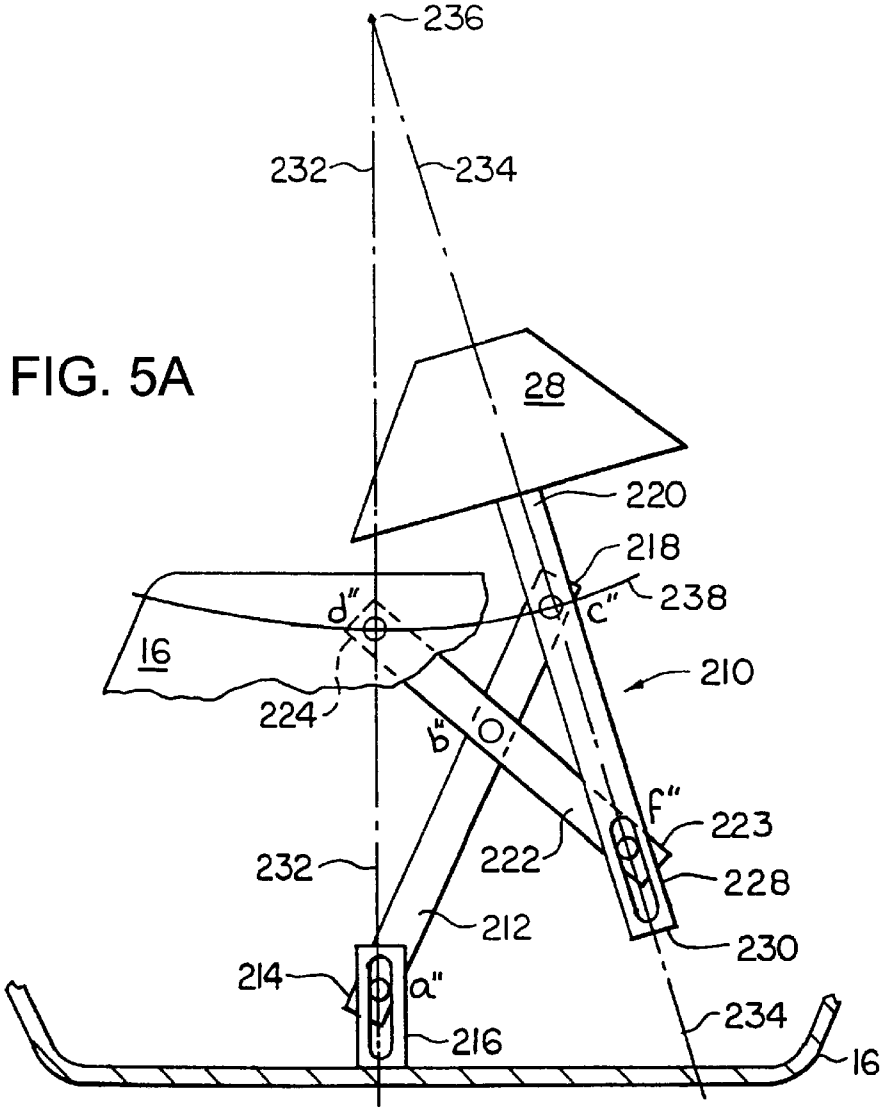
Figure 5C:
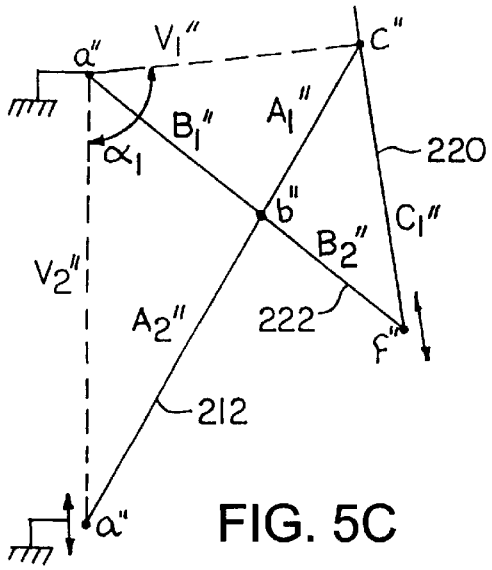
Figure 5D:
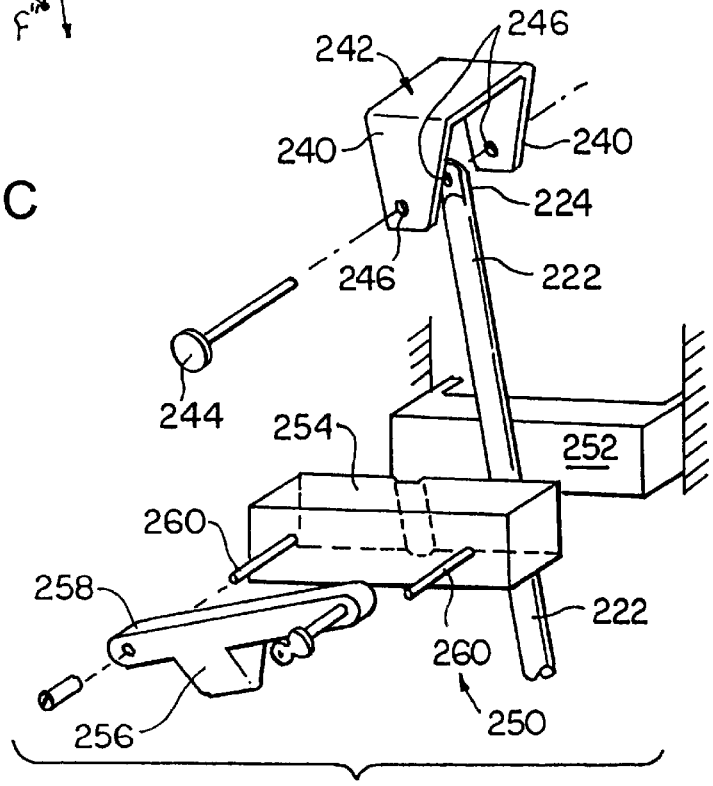
FIGS. 5*d* and 5*e* are exploded perspective and front views, respectively, of a brake mechanism for a moving chair, in accordance with another embodiment of the present invention.
Figure 5E:
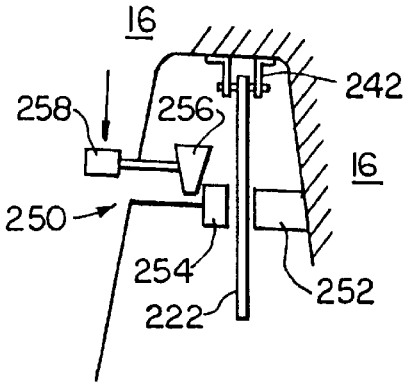

The details of the pivot joint between link 222 and housing. 16 are shown in FIGS. 5*d* and 5*e*. The flattened end 224 of link 222 is inserted between the lobes 240 of a U-shaped bracket 242 attached to housing 16. A rivet 244 inserted through holes 246 in the lobes 240 of U-shaped bracket 242 and flattened end 224 allows link 222 to pivot with respect to bracket 242.

A brake mechanism 250 for stopping the rocking motion of linkage assembly 210 and chair support 28 is also shown in FIGS. 5*d* and 5*e* and may also be applied to other linkage assemblies. Brake mechanism 250 includes a fixed brake pad 252, made of a compliant material such as rubber, attached to housing 16. Throughout its range of travel, link 222 remains between fixed brake and 252 and an opposed movable brake pad 254, which is also made of a compliant material such as rubber. A wedge 256 engages the back side of movable brake pad 254. When a handle 258 attached to wedge 256 is rotated downward in the direction indicated by the arrow in FIG. 4*e*, wedge 256 forces movable brake pad 254 along slider pins 260 toward fixed brake pad 252, trapping link 222 in between.

Figure 3D:
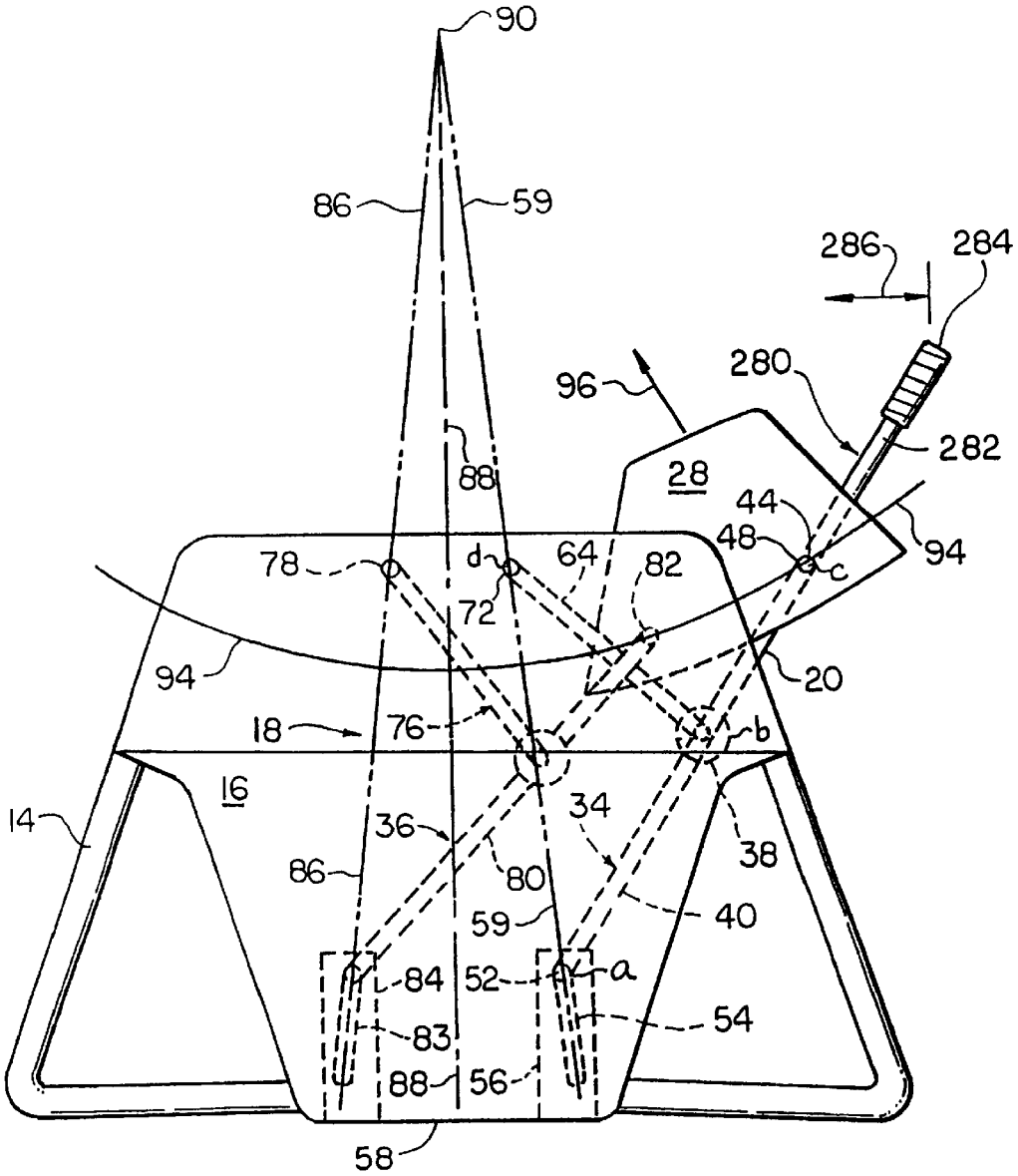
FIG. 3*d* is a side schematic view of the linkage assembly showing a push-handle attached to one of the links that is connected to the chair.

Referring to FIGS. 3*d* and 3*e* there is provided a push handle designated generally by numeral 280 for use by a person seated in the chair 12 to manually create the desired fore and aft movement without significant effort. Referring specifically to FIG. 3*d*, the handle 280 comprises an extension.of the link 20 of the pivot linkage 18. The body portion 282 of the handle 280 includes a grip 284 at the terminal end thereof. Movement of the handle 280 fore and aft in the direction of arrow line 286 will cause corresponding fore and aft movement of the chair support 28 and chair 12. With regard to the handle, it is to be understood that the positioning of the handle 280 is not limited to the specific location as described herein. The handle 280 may be connected to any point on the linkage assembly 18 which extends between the base support 14 and the chair support 28 as long as the terminal end of the handle is in a suitable location for grasping by the user seated in the chair. Movement of the handle 280 will thereby causes a relative movement of the chair support 28 relative to the base 14.

Referring now to FIG. 3*e*, a detailed view is shown of the handle of FIG. 3*d*. Seat 10 may be provided with an alternative braking assembly on the handle 280 for preventing oscillating movement of the chair support 28. In this regard, the handle 280 is split into lower and upper portions 288, 290 respectively, which are pivotally connected along a transverse pivot axis 292. The upper handle portion 290 thus pivots inward and outward relative to the lower handle portion 288 along arrow line 294. The braking assembly is defined by interlocking formations formed on the upper handle portion 292, and on either the chair support 28, or the housing frame base 14. In the illustrated embodiment, the interlocking formations comprise a locking T-pin 296 mounted to the upper handle portion 292, and a corresponding slot 298 formed in the body of the chair support 28.

In this regard, inward movement of the upper handle portion 292 rotates the locking pin 296 into the slot 298 to prevent movement of the chair support 28. While a preferred braking assembly is illustrated and described, it is to be understood, that the braking assembly may alternately comprise other types of interlocking formations, and that the braking assembly may be positioned at alternate locations on either the handle or other elements of the apparatus.

In many applications, chair 12 may be satisfactorily moved through direct application of force by the person seated therein. It may moreover be desirable to drive the linkage assembly by means of a motor. Drive mechanisms 1310, 1312 for fore linkage 34 of linkage 18 (FIGS. 3*a*, 3*b*, and 3*c*) are shown in FIGS. 6*a* and 6*b*. Of course, mechanisms 1310, 1312 could be readily modified for use with other linkages, such as linkages 110 and 210.

Drive mechanism 1310 includes an electric or spring motor 1314 that drives a pinion gear 1316 through a worm gear 1318. A link 1320 pivotally attaches at one end to pinion gear 1316, and at the other end to a short link section 1322. Short link section 1322 is pivotally attached to housing 16 at or near hole 72 (i.e, the pivot joint between link 64 and housing 16). A spring steel blade 1324, laterally constrained at its midpoint by pins 1326 projecting from link 64, attaches to the free end of short link section 1322.

As pinion gear 1316 rotates, link 1320 causes short link section 1322 to pivot back and forth. Through the compliant connection provided by spring steel blade 1324, this imparts a lateral force to pins 1326 and link 64, causing fore linkage (and thus also chair 12, not shown) to rotate. The motor speed may be adjusted to drive the linkage at or near its natural frequency.

Drive mechanism 1312, shown in FIG. 6*b*, is similar to drive mechanism 1310, except that a spring 1328 connects at one end to pinion gear 1316, and at the other to link 64.

As an example, although in the embodiments shown and described above the links are straight, they may be bent or otherwise shaped as necessary. As illustrated in FIGS. 7*a* and 7*b*, a linkage assembly 410 includes a U-shaped yoke 412 pivotally mounted to housing 16 by pivot joints 414, and a Y-shaped yoke 416, one end 417 of which slides in a slider 418 attached to housing 16. A load such as a chair support 28 (not shown) may be coupled, through pivot joints 420, to the top of Y-shaped yoke 416. U-shaped yoke 412 passes through holes 422 in a pair of lobes 424 attached, e.g., by welding, to the upright arms of Y-shaped yoke 416. As shown in FIG. 7*b*, Y-shaped yoke is-bent so that end 417, pivot joints 420, and holes 422 are collinear. Linkage assembly 410 may for example be substituted for either or both of the fore and aft linkages 34, 36 of the embodiment shown in FIGS. 3*a*, 3*b*, and 3*c*.

Figure 8:
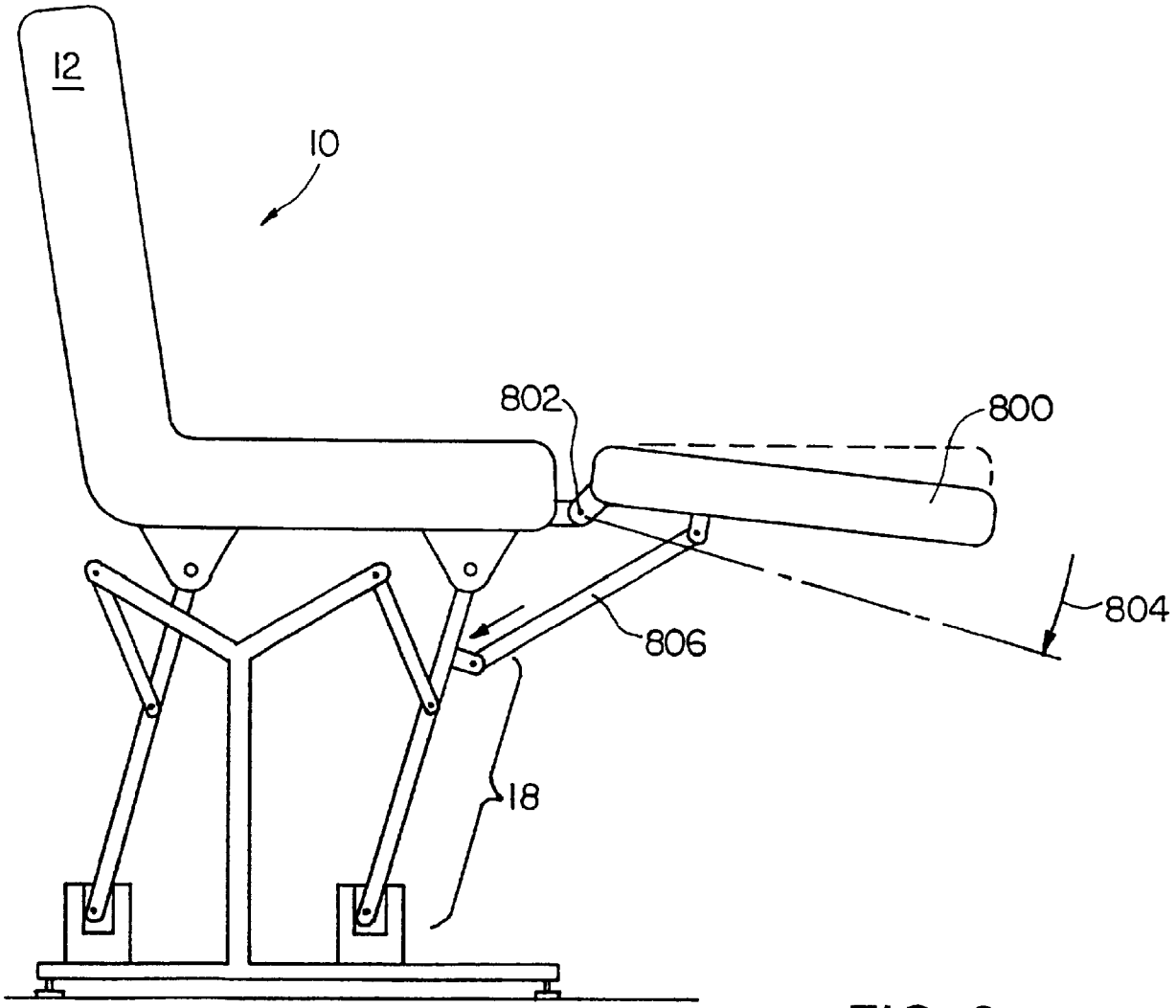
FIG. 8 is a side view of an oscillating seat including a leg- or foot-powered rocking actuator in accordance with an embodiment of the present invention.

FIG. 8 shows a side view of an oscillating seat 10 including a leg- or foot-powered rocking actuator in accordance with certain embodiments of the present invention. Foot pedal 800 is coupled to support assembly 12 at pivot 802 so that it may travel about an angular range designated by numeral 804. Foot pedal 800 may comprise a portion, up to the entirety, of a foot rest for supporting part of the body of the subject seated on support assembly 12. By depressing foot pedal 800, the occupant of the seat actuates linkage mechanism 18 to which foot pedal 800 is coupled via connector 806 which may be a link, as shown, or any other coupling known to persons skilled in the mechanical arts.

A self-centering lock and brake mechanism, in accordance with certain embodiments of the present invention, is now described with reference to FIGS. 9*a* and 9*b*. Operation of the brake mechanism, designated generally by numeral 900, is based on the principal that link 64, coupled to the support assembly at pivot d, is coaligned with link 20 substantially at the center of the horizontal stroke of the support assembly. Thus, the action pinning link 20 in coalignment with link 64 serves to lock support assembly 12 serves to lock the support assembly at a fixed position in its path of motion relative to the fixed segment of the apparatus. In accordance with a specific embodiment of the invention, handle 6 is coupled to sliding housing (or "sleeve") 902 which translates substantially coaxially with, and external to, link 64. The end of sleeve 902 distal to handle 6 has a radially extending pin 904 engaged in Y-shaped slot 906 of yoke 908. Yoke 908 is attached to link 64. Link 64 is locked in relation to link 20 by pushing downward on handle 6, from the position designated by numeral 910 to the position designated by numeral 912. Yoke 908 and pin 904 are advantageously disposed in proximity to pivot point b between links 20 and 64 such that the horizontal travel of pin 904 is small, and the dimensions of slot 906 are correspondingly small. FIG. 9*b* shows brake mechanism 900 is an unbraked position. By pushing down on sleeve 902, pin 904 is urged downward within shaped slop 906, thereby causing links 64 and 20 to be brought into coalignment, and, in the self-same movement, to be brought into the locked position shown in FIG. 9*a*, thus preventing further motion of the support assembly to until the mechanism is unlocked by the occupant.

Figure 9A:
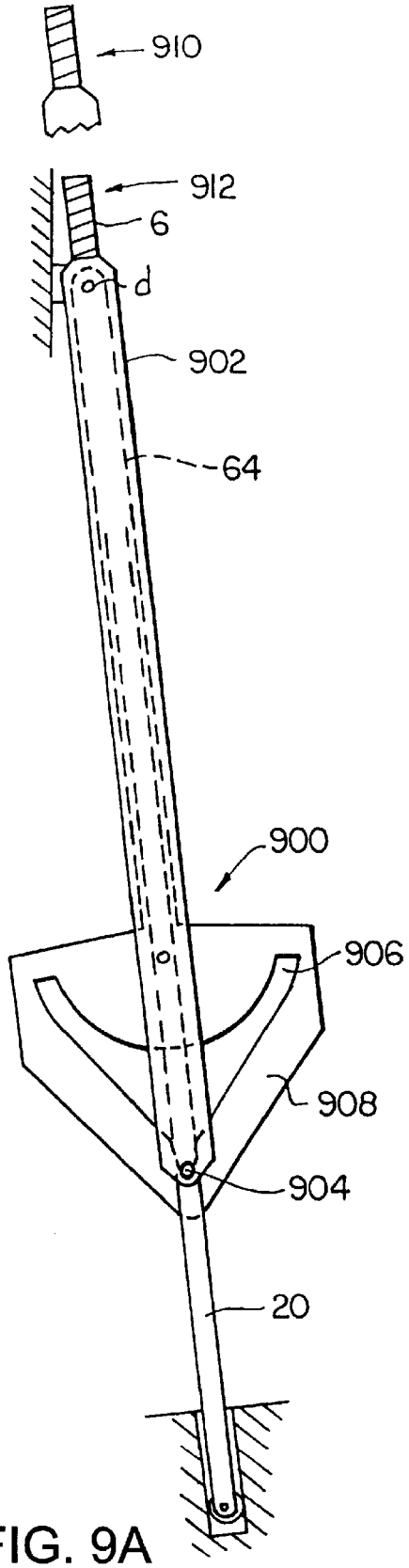
FIG. 9*a* is a side view of a self-centering lock and brake handle in accordance with an embodiment of the present invention, wherein the lock is shown in an engaged position.
Figure 9B:
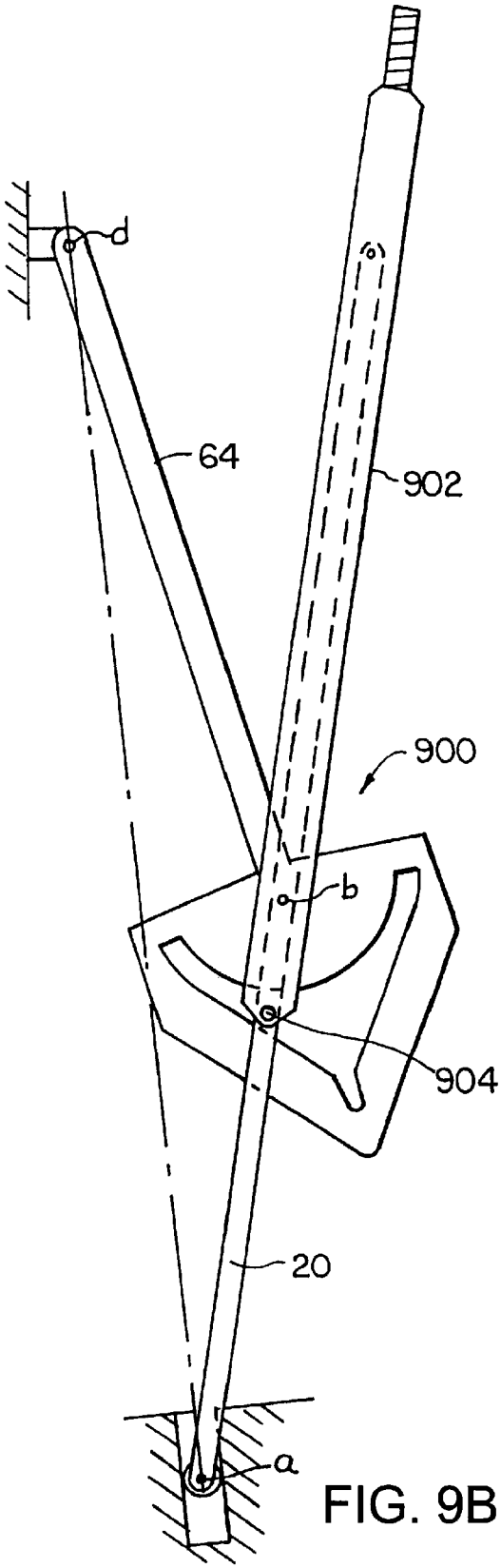
FIG. 9*b* is a side view of the self-centering lock and brake handle of FIG. 9*a*, shown in a "free" position.

Referring once more to FIG. 1, a self-centering lock, brake, and drive mechanism, similar to that described with reference to FIGS. 9*a* and 9*b*, is shown. Here, yoke 9 (corresponding to yoke 908 of FIG. 9*a* ) is incorporated into the support assembly, and may be notched, by milling or otherwise, directly into the seat support structure. Yoke 9 is disposed just below the upper point of the pivoted attachment of link 20 to the support assembly. As described with reference to FIGS. 9*a–b*, pushing down on handle 6 causes pin 904 to engage Y-shaped slot 906 (shown in FIG. 9*a*) so as to center and lock the mechanism. However, in the embodiment shown in FIG. 1*a*, the axis of handle 6 is not necessarily aligned or coaxial with either of links 20 or 64.

Figure 10A:
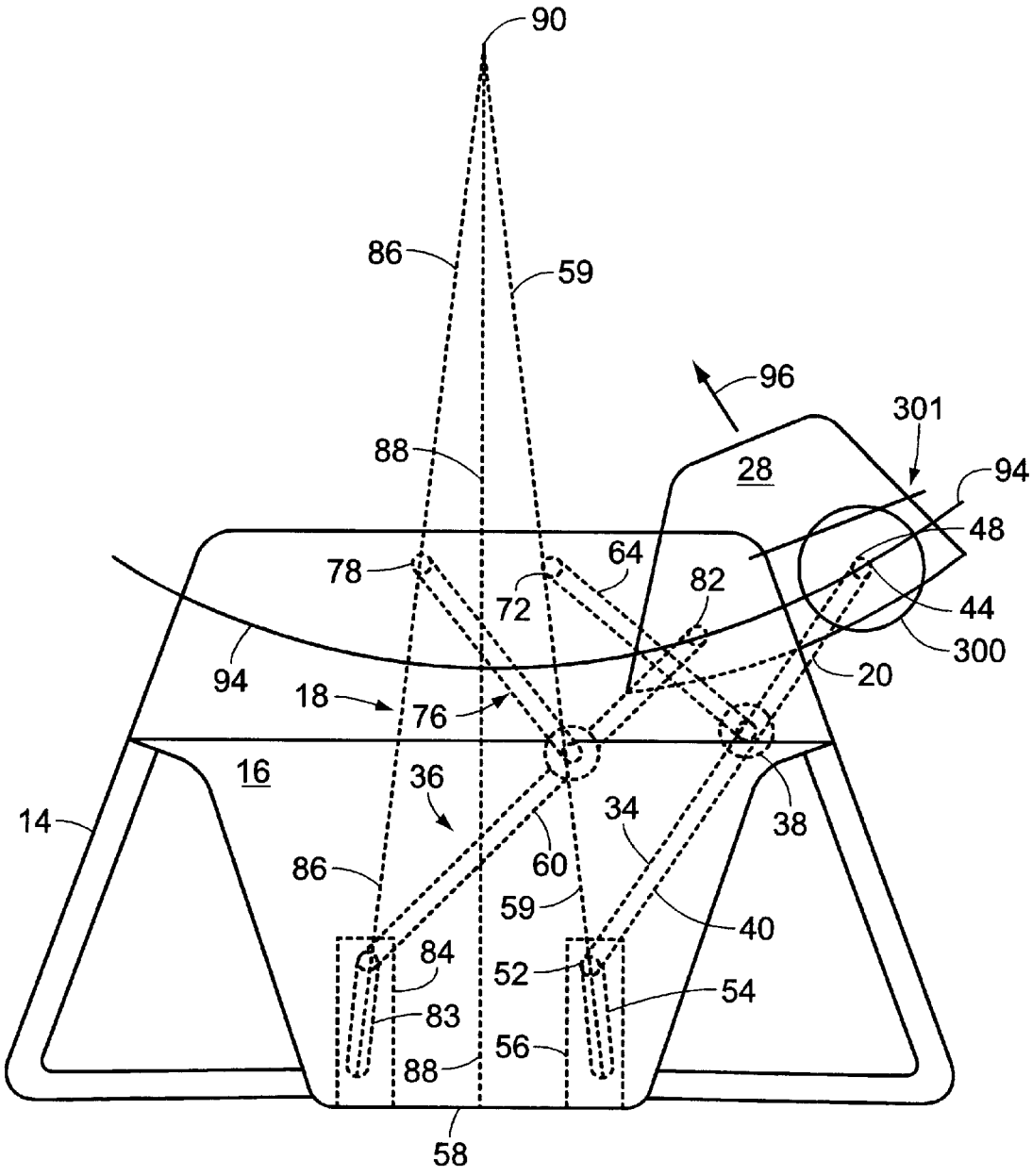
Figure 10B:
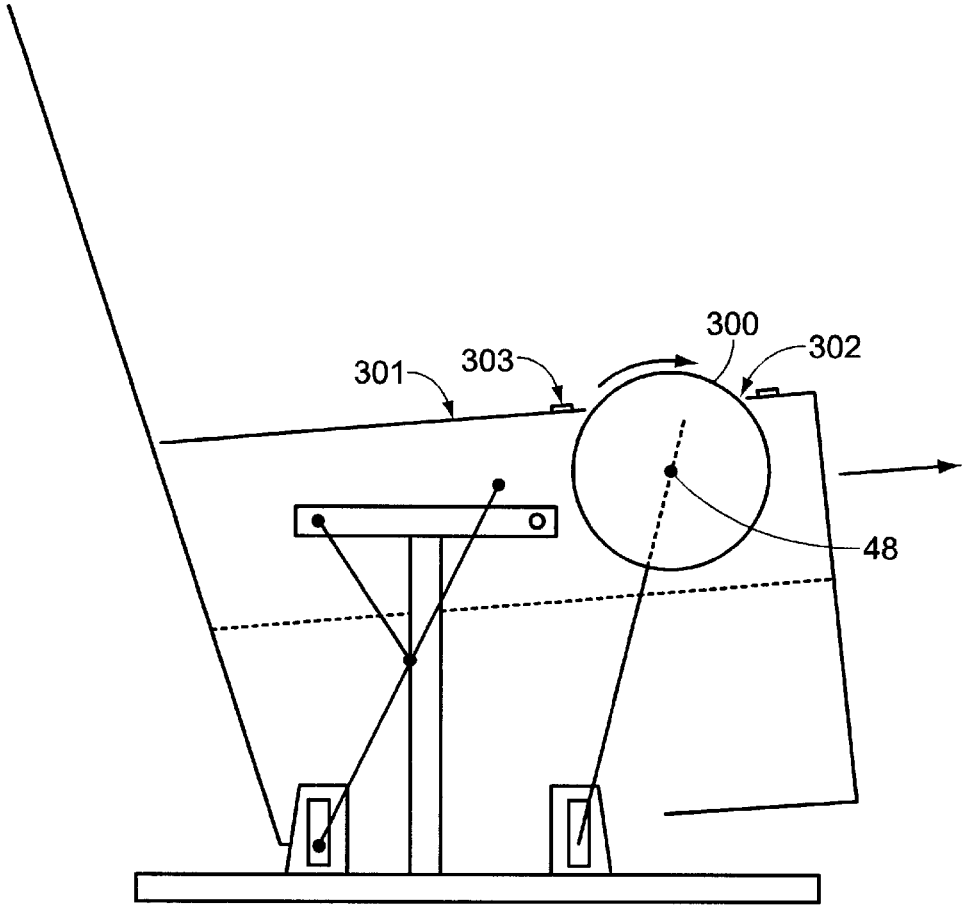
Figure 10C:
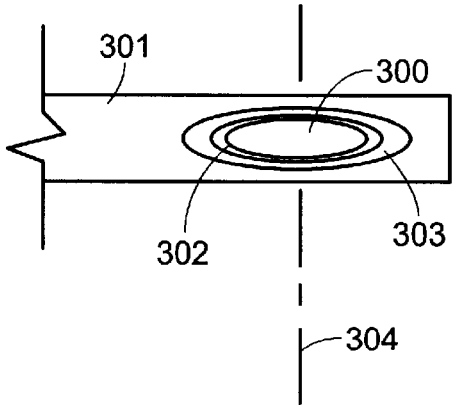
FIG. 10*c* is a top view of the embodiment of FIGS. 10*a* and 10*b*, looking down on arm 301.

FIGS. 10*a* and 10*b* show another embodiment of the present invention wherein a handwheel 300 replaces handle 284 of FIG. 3*d*. In FIG. 10*a* there is further shown handwheel 300 rotating about point 48, with the top portion of handwheel 300 above arm surface 301 so that a person seated can rotate handwheel 300 by hand, thereby imparting a torque about point 48 and causing the chair to move. Trim plate 303 is shaped to provide a constant minimal gap 302 between handwheel 300 and plate 303 so as to minimize any possible pinch point as the chair moves and handwheel 300 rotates. Use of the handwheel as a manipulandum reduces the risk (in comparison to the use of a handle 284 in FIG. 3*d*) that the manipulandum would inadvertently pinch the user's hand in the slot through which the manipulandum protrudes. The rotating handwheel 300 and plate 303 cooperate to maintain a constant distance between themselves and to preclude a change in dimension between those parts being caused by movement of the chair and rotation of handwheel 300. FIG. 10*c* is a view of the same embodiment looking down at arm 301 and handwheel 300 and shows the constant gap 302 all around and between handwheel 300 and plate 303.

Figure 11A:
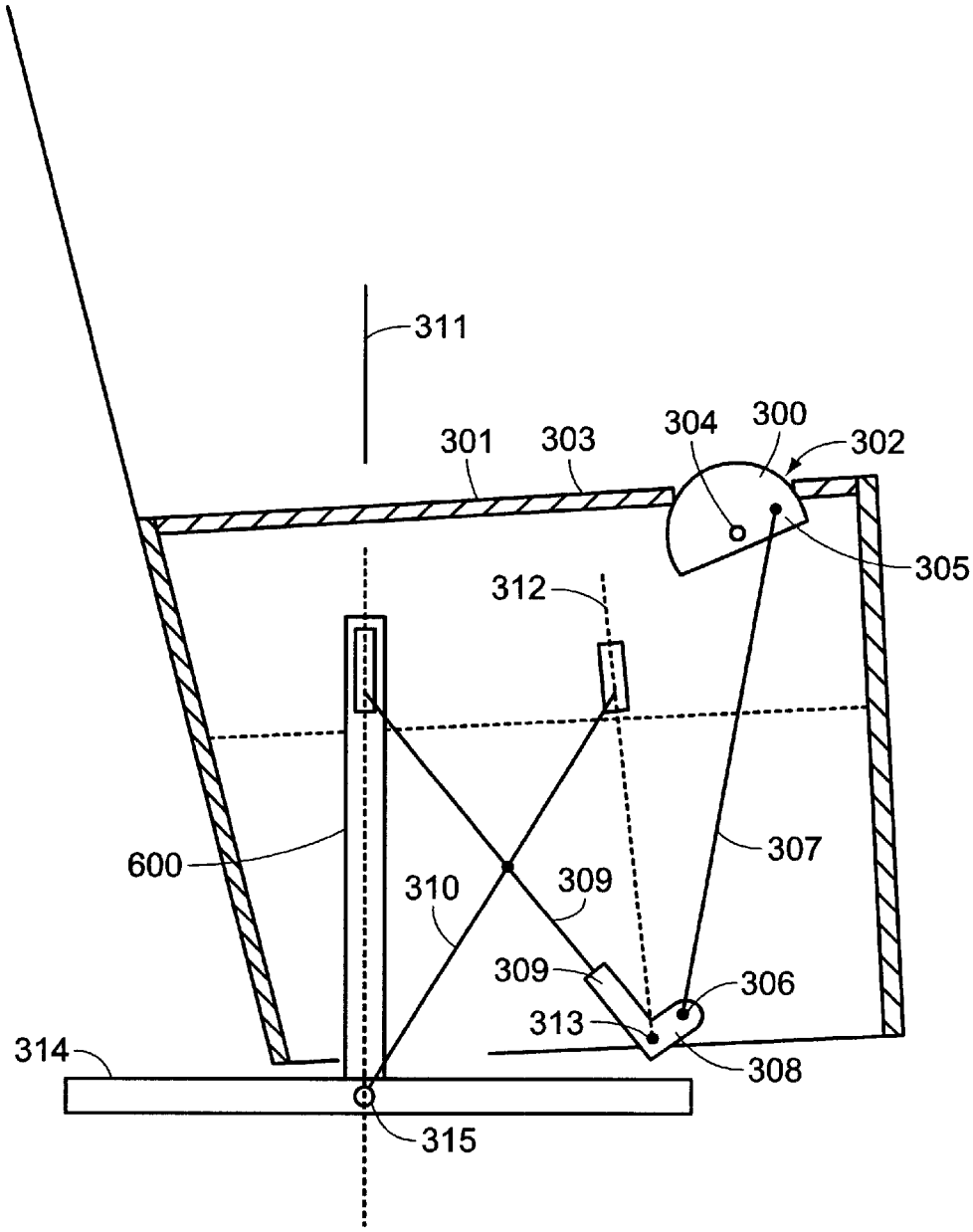
FIG. 11*a* shows another embodiment of the present invention employing a handwheel and wherein the linkage arrangement is differently configured.

FIG. 11*a* shows another embodiment of the present invention employing a handwheel wherein the linkage arrangement is differently configured. In particular, FIG. 11*a* shows a swing linkage as seen in FIG. 5*a* but now inverted or upside down. FIG. 11*a* also includes the connecting linkage between handwheel 300 and the extension member 308 at the bottom of link 309. Link member 307 connects to point 305 on handwheel 300 and to point 306 on extension member 308. Rotating handwheel 300 now transmits a force through link 307 to point 306 thereby causing a torque about point 313 and causing the chair to move.

Figure 12A:
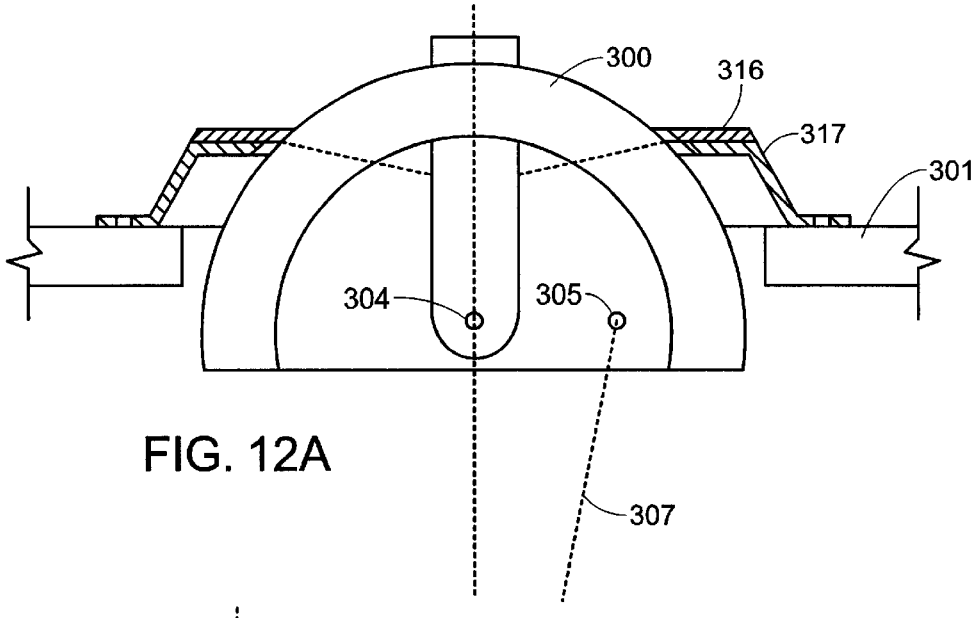
FIGS. 12*a*, 12*b*, and 12*c* show details of an embodiment for mounting of a handwheel for use in connection with various embodiments of a moving chair as described herein.
Figure 12B:
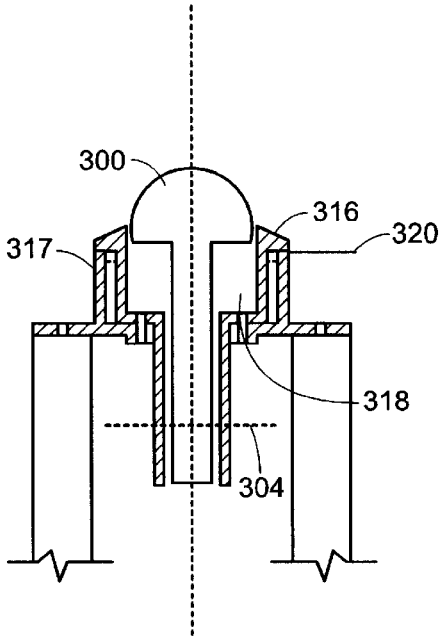
Figure 12C:
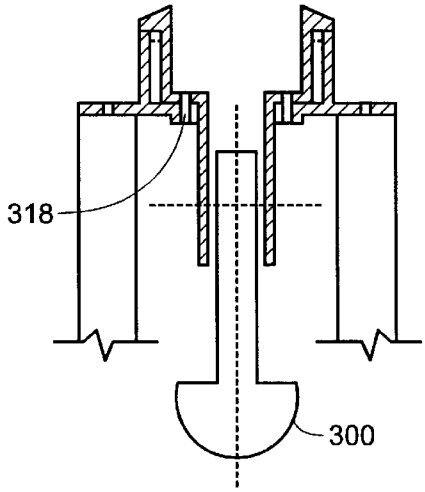

FIGS. 12*a*, 12*b*, and 12*c* show details of an embodiment for mounting of a handwheel 300 for use in connection with various embodiments herein. In order to facilitate manufacturing and avoid damage to visible finished parts, it is desirable to install finished and exposed parts after the chair has been upholstered. Therefore, as shown, sub-base 317 is stapled to the top of wood arm structure 301, then foam and upholstery are applied, with the upholstery being stapled to the top of sub-base 317 and taking up the gap 320 shown in FIG. 12*b*. After all upholstery is finished, the complete handwheel assembly, including link 307 and trim plate 316 can be dropped into sub-base 317. Trim plate 316 can be secured to sub-base by a snap-fit or by screws 318. Screws 318 are made accessible by rotating handwheel 300 approximately 180 degrees as shown in FIG 12*c*. In this way screws 318 are hidden in normal use. Screw access is possible because handwheel 300 does not form a complete circle and has had a portion removed. That missing portion is, in normal use, below pivot point 304. Upon rotating handwheel 300 by 180°, the entire inside area of trim plate 316 and screws 318 are accessible.

Figure 13B:
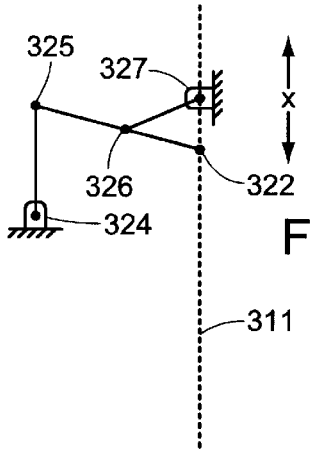
FIGS. 13*a*, 13*b* and 13*c* show further embodiments for configuration of linkages in accordance with the present invention.
Figure 13A:
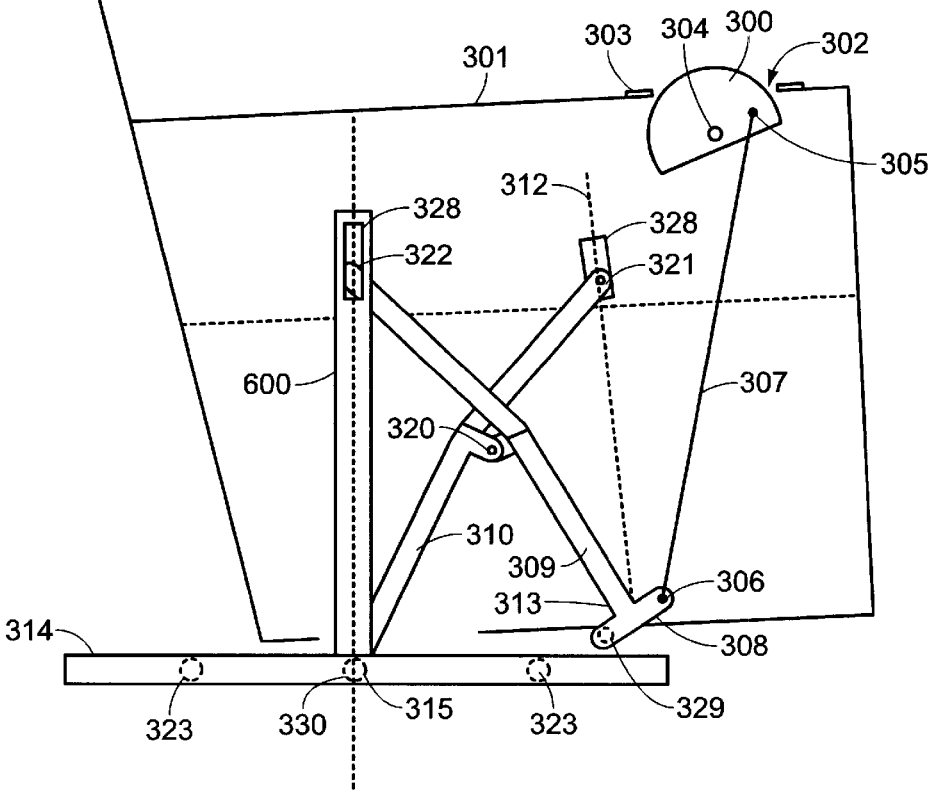
Figure 13C:
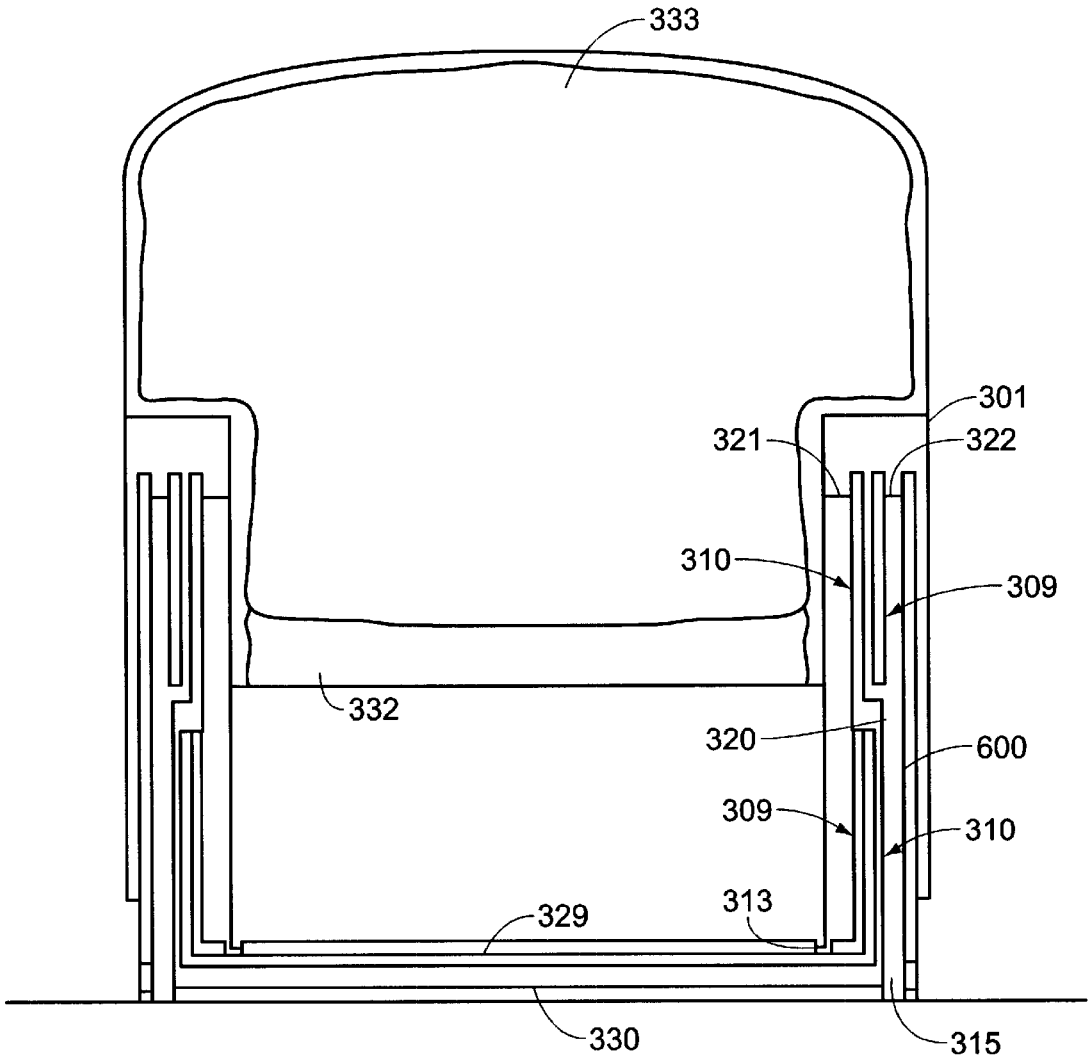

FIGS. 13*a*, 13*b*, and 13*c* depict further embodiments for configuration of linkages in accordance with the present invention; these embodiments may be understood as specific implementations associated with the linkage shown schematically in FIG. 11*a*. Specific characteristics of the linkage shown allow the "X" configuration of link members 310 and 309 to cross each other in moving from a forward swing to a rearward swing and specifically allow the bottom of link 310 to be outside the bottom of link 309, and link 310 to be pivotally attached at its lower end at point 315 to the outer frame 314 while the lower end of link 309 is pivotally attached to an inner surface of chair arm at point 313. Above the pivotal connection between link 310 and 309 at point 320, link 310 now is offset inward while link 309 is offset outward, allowing the top of 309 to now be pivotally moving along line 311 at outer frame member 314, while the top of link 310 is now pivotally moving along line 312 on the inner surface of chair arm. This offset characteristic allows the links 310 and 309 to cross and to be connected to their appropriate structural support points at both the top and bottom of each link as required by the geometry of the linkage system.

As shown in FIG. 13*a*, each side of frame 314 is connected to the other by cross-tubes 323 which impart stiffness to the upper portion of frame 314 but are low so as to minimize interference with moving linkage members. This creates a "U" shaped frame when viewed from the front. In the and in the cross-sectional front view of FIG. 13*c*, it is likewise apparent that links 310 on each side of the chair are connected to each other by a cross-tube 330, and links 309 are connected by cross-tube 329, thereby creating two stiff "U" shaped link pairs which cross and move past each other, providing overall stiffness and structural integrity for side and other load orientations while the offset characteristic allows the links to meet the geometric requirements necessary to provide the desired motion.

The configuration of FIG. 13*a* confers important benefits in the geometry and construction of oscillating furniture. In particular the modified X design enables the cross members 330 and 329 connecting link pairs to be contained at ideally low locations below the moving portion of the furniture (even through cross member 329 moves with the moving portion of the furniture). It can be seen that the cross member 330 (the end of which coincides, in the position shown with fixed pivot point 315) is at approximately the same level as the frame cross members 323. The modified X design also permits a.large travel in each direction of oscillation for a given size of the oscillatory mechanism. What this means is that modified X design can fit in a reasonably sized arm cavity of a chair and permit a large travel in each direction of oscillation.

Further, with reference to FIG. 13*a*, the vertical projection -of frame 314 contains slide 328 and point 315 and the centerline of the fore-aft stroke of the oscillatory mechanism. This modified X design, which has a small fore-aft arm dimension of the vertical projection of frame 314 allows for a small fore-aft arm cavity thereby allowing a sufficiently large stroke to be accommodated as is aesthetically pleasing and standard arm size and shape.

The X link format of FIG. 13*a* advantageously provides lateral stiffness through the cross tubes while allowing the tubes to pass each other and yet staying as low as possible to allow room for other components and minimize stress on the vertical structure component, post 600.

While the oscillatory mechanism is shown in FIG. 13*a* in the arm cavity, another embodiment of such a mechanism may be placed under the seat thereby using space other than that in the arm cavity. In either case, the modified X design allows the oscillatory mechanism to be located, hidden, and protected in or under a chair with a small and aesthetically pleasing standard side profile.

Figure 11B:
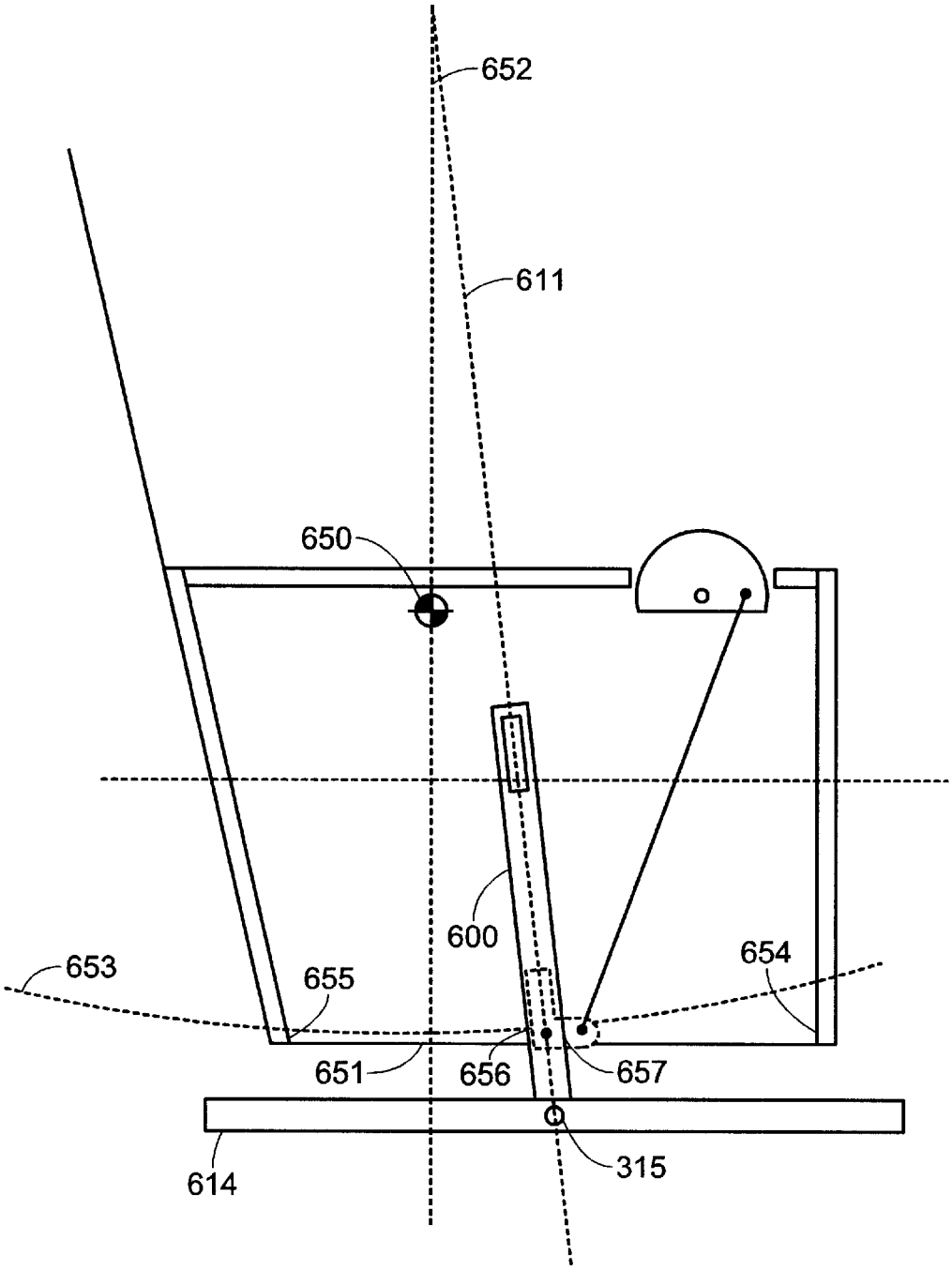
FIG. 11*b* shows a slightly modified embodiment of the invention with a tilt of the axis of the vertical structure member, and further illustrates the disposition of components at the center of travel of the support.

FIG. 11*b* shows an embodiment of a motion chair utilizing the linkage mechanism as in FIG. 11*a* and FIG. 13*a*, but with the further feature that vertical member 600, otherwise referred to herein as the "post," is tilted, along axis 611, with respect to frame member 614, so as to position the center of gravity (CG) 650 of the moving portion of the chair-with-occupant and the midpoint 651 of the motion of the chair, aft of the geometrical center of the chair.

The center of gravity (CG) 650 of the chair-and-occupant is typically to the rear of axis 611 and the center of a chair that is aesthetically pleasing and standard in size and shape, and, insofar as the CG will, at rest, be located at the point of the lowest potential energy and at low point 651 on arc 653, axis 611 of post 600 is preferably inclined rearward, thereby locating the lowest point 651 of arc path 653 beneath CG 650 of the chair/occupant combination. This allows the oscillating mechanism to be located at the center of the side profile while the above referenced center of gravity is to the rear of the center of the side profile.

Such an arrangement cooperates to allow a maximal stroke for a given side profile even when the center of gravity is displaced from the center of the profile.

FIG. 11*b* also illustrates the oscillatory mechanism at its center of travel, with links 309 and 310, shown in FIG. 11*a*, coaligned with post 600. The clearance for forward stroke of the chair relative to the midpoint shown is given by the distance between point 655 and the rear extent 656 of the base of post 600. Similarly, the clearance for rearward stroke of the chair relative to the midpoint shown is given by the distance between point 654 and the forward extent 657 of the base of post 600.

FIG. 13*b* shows an alternate linkage system in which pivots 324, 325, 326, and 327 may replace slides 328 to allow straight line travel of points 322 and 321 along lines 311 and 312 respectively.

Figure 14A:
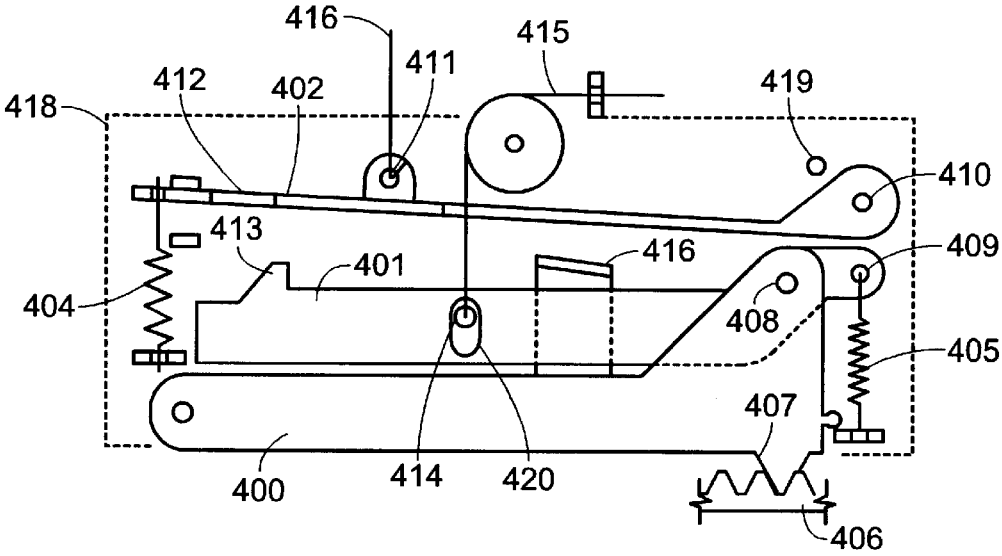
FIGS. 14*a*, 14*b*, and 14*c* show an embodiment of the present invention providing an automatic lock system.
Figure 14B:
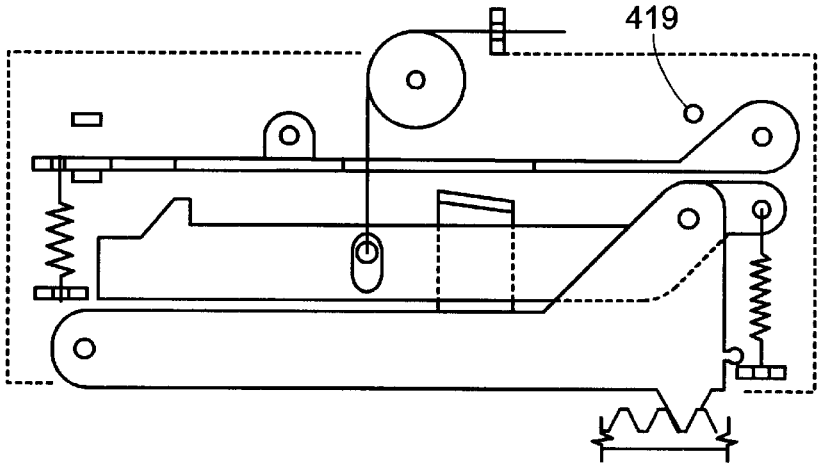
Figure 14C:
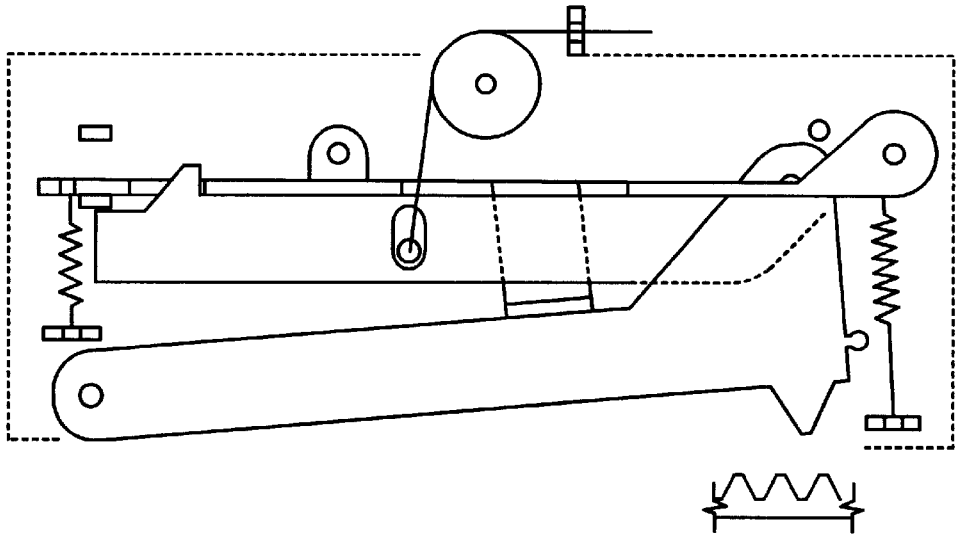

FIGS. 14*a*, 14*b*, and 14*c* show an embodiment of the present invention providing an automatic lock system. This lock system reduces the risk that the chair can swing or move before someone is already seated and while seated has pushed a release button. Upon leaving the chair, the chair returns automatically to a locked position so it cannot move. This system has the further advantage of ensuring that the seat surface will be stationery when someone is trying to sit down and is therefore potentially safer than a normal chair whose motion of rocking or gliding is typically locked out only when the seat is reclined. Accordingly, this lock system may be used with chairs providing any type of motion, with swing motions, or with various known and existing rocking or gliding chairs.

FIG. 14*a* shows the lock system of this embodiment in the unseated and locked position. Preventer link 402 pivots at point 410 and is shown in the up position against the upward position stop and is maintained in that position by the upward pull of wire 416 which is attached to the seat spring. When the seat is unloaded and not compressed downward, cable 416 is tensioned and keeps preventer 402 above link 401, thereby preventing tooth 413 of link 401 from engaging slot 412 of preventer 402. Accordingly, even when release button is pushed so as to exert an upward pull on cable 415, lifting link 401 and link 400, upon releasing the spring mounted release button attached to cable 415, the cable 415 then immediately goes slack and the system returns to a locked position. Springs 404 and 405 bias links 401 and 400 downward and to the locked position with lock tooth 407 engaged in rack 406. Stop 419, working in conjunction with stop 416, keep links 401 and 400 from being raised too high and specifically keep tooth 413 from engaging slot 412 unless preventer 402 is released to its lower position as a result of the seat being loaded and lowered by the weight of a seated occupant. Housing 418 contains the lock system and is mounted to the lower moving portion of the chair, while rack 406 is fixed to the stationery frame. The length of rack 406 may be adjusted to allow a range of lock positions along the path of motion of the chair and should be shaped to follow the path of motion of the chair.

FIG. 14*b* shows the system as it would be with a seated occupant. Note that the preventer 402 is at its lower stop position and the system still remains locked.

FIG. 14*c* shows the system as it would be with a seated occupant and unlocked. Cable 415, having been tensioned by pushing a release button preferably positioned on top of the arm, has pulled link 401 and 400 upward thereby locking link 401 to preventer 402 and keeping lock tooth 407 of link 400 disengaged from rack 406. It can be seen that when the seated occupant gets out of the chair, the preventer 402 is elevated and the system locks. It can be seen that the release button may be either spring mounted or have multiple positions so that the lock system can allow the seated occupant to choose a locked or unlocked position of the release button, so that the system can be locked or unlocked while seated with the release button indicating a locked or unlocked position. Regardless of button position, upon getting out of the chair, the system will return to the locked position.

Figure 15:
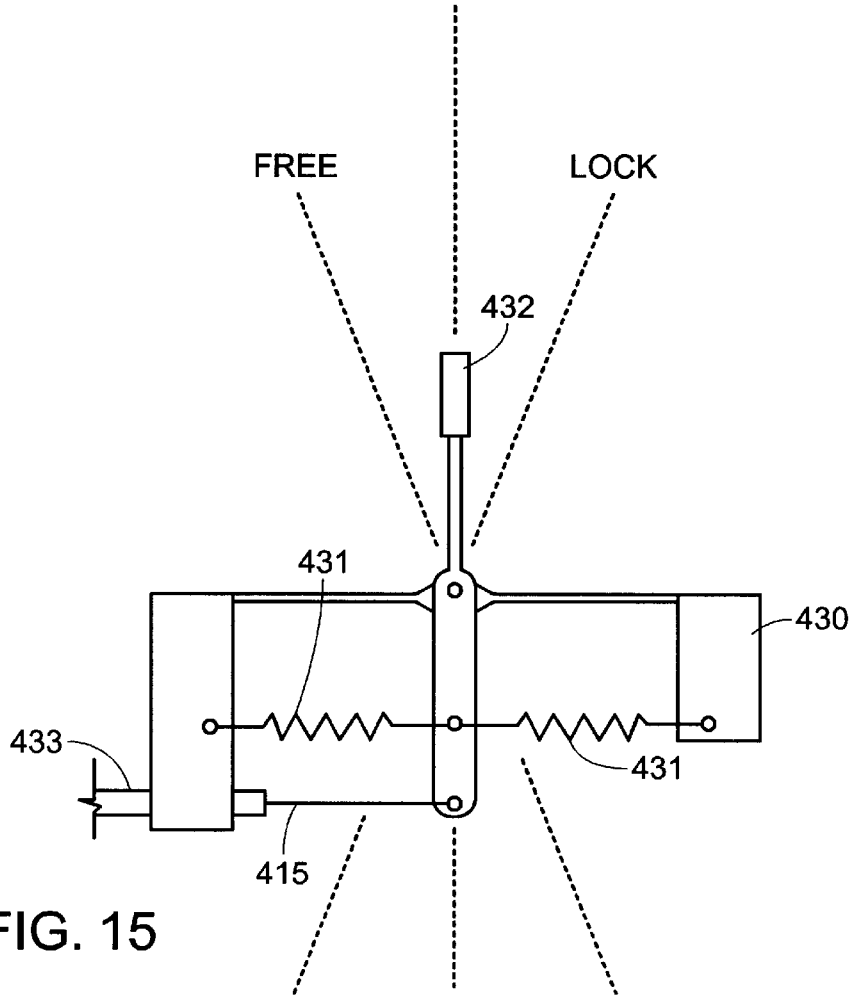
FIG. 15 shows a preferred release button or lever to be mounted on the arm of the chair to operate the embodiment of FIGS. 14*a*, 14*b*, and 14*c*.

FIG. 15 shows a preferred release button or lever to be mounted on the arm of the chair to operate the embodiment of FIGS. 14*a*, 14*b*, and 14*c*. Lever 432 is biased by springs 431 to return to the center position unless pushed and held to the lock or free position by a seated occupant of the chair. Pushing the lever 432 forward to the lock position pushes cable 415 into the cable carrier 433, while moving lever 432 to the free position pulls cable 415 out of the carrier 433. With reference now to FIGS. 14*a*, 14*b*, and 14*c* it can be seen that the end of cable 415 is attached to an end point 414 which is free to slide in slot 420 in link 401. In each of FIGS. 14*a*, 14*b*, and 14*c*, end point 414 is shown at its location when lever 432 is in its center position. Note that in FIG. 14*a*, when no one is seated in the chair, end point 414 is at the top of the slot 420 and moving lever 432 in either direction has no effect and the system remains locked since preventer 402 is up. In FIG. 14*b*, with someone seated in the chair, moving the lever 432 to the lock position only moves endpoint 414 to the bottom of the slot 420 and has no effect. Moving lever 432 to the free position lifts link 401 and engages tooth 413 in slot 412 of preventer 402 thereby maintaining lock system in a free and unlocked position until either the occupant gets out of the chair or the occupant pushes lever 432 toward the lock position, whereupon in either case the system will lock to prevent motion of the chair. FIG. 14*c* shows the lock system unlocked and end point 414 at the bottom of slot 420 (with lever 432 at its center position) so that moving lever 432 toward the free position will have no effect but moving lever 432 toward the lock position will cause link 401 to be released from preventer 402 and the system will lock.

Referring now to FIGS. 16*a*–16*e*, and alternate embodiment of the moving chair is shown in which an automatic lock automatically centers the chair and then locks the chair when the occupant gets out of the chair. This embodiment allows the occupant to unlock the chair only when seated and when the seated occupant pulls the lock handle to the free position. When no one is in the chair, pulling the lock handle to the free position can be done but the handle will not stay latched into the free position unless someone is in the chair. Accordingly, unless someone is in the chair, the handle will return by spring force to the locked position.

Figure 16A:
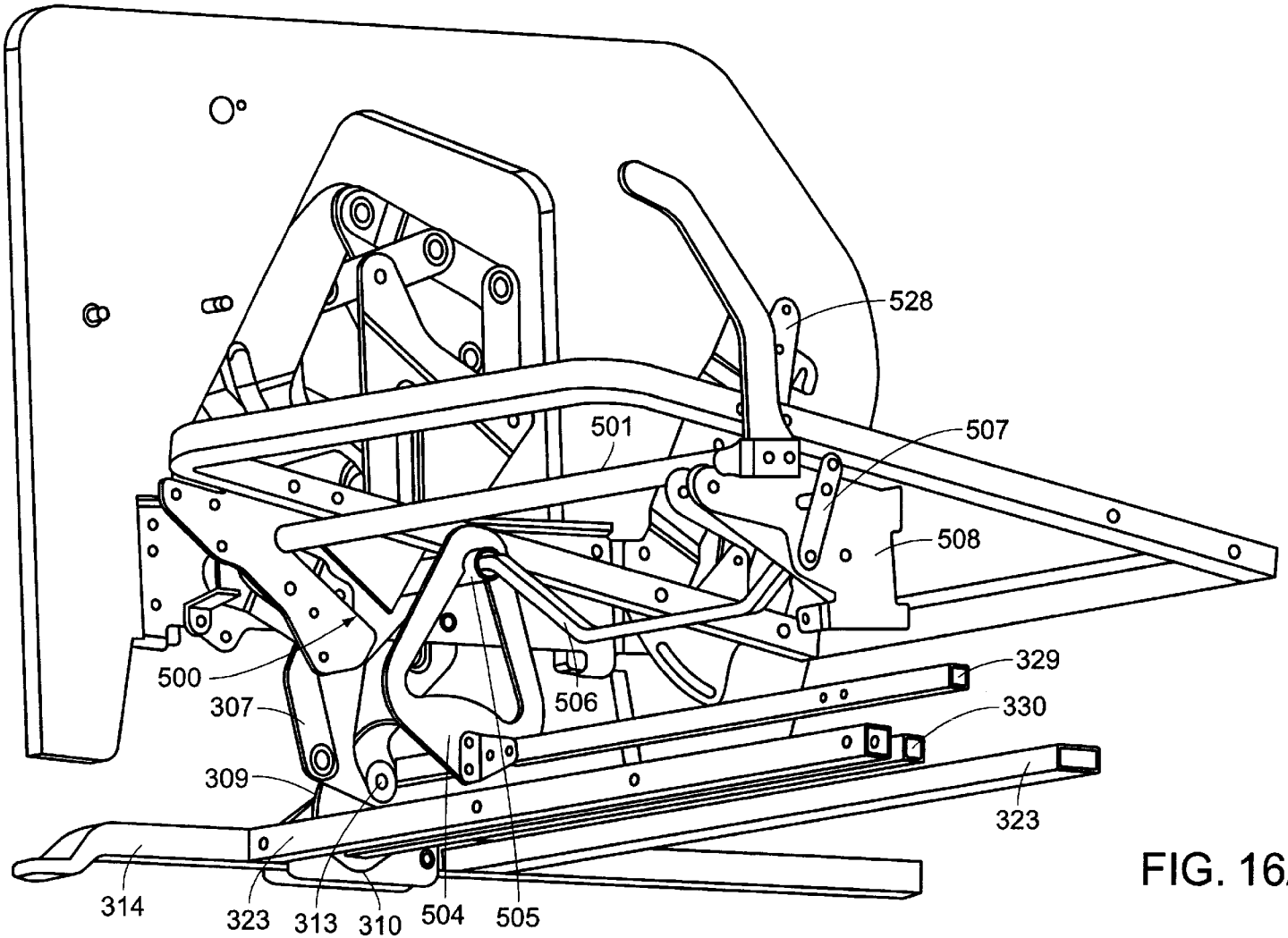
FIGS. 16*a*–16*e* show perspective views of an alternate embodiment of a moving chair in which an automatic lock automatically centers and locks the chair in accordance with embodiments of the present invention.

FIG. 16*a* shows a perspective view of one side of the invention with opposite side components hidden for clarity. Referring to FIG. 16*a*, seat support frame 503 is attached to slot member 500 and frame 503 pivots at point d when back support member 528 pivots about point a and causes frame 503 to move forward and upward as the top of member 528 is pivoted rearward. Cross tube 501 is fixed to plate 527 and to the inside of the plywood arm 529 and by engagement with slot 500 allows seat frame 503 to move with the recline position and pivoting at points a and d. This is the forward movement of the seat coupled to the rearward recline of the seat back earlier described which advantageously maintains the CG of the moving portion of the chair and occupant to stay in substantially the same forward and aft position in both upright and reclined positions.

Shaped lock plates 504 are fixed to cross member 329. Since member 329 is fixed to link 309, lock plates 504 pivot about point 313 and through an arc as the chair oscillates from front to back. Lock tube 506 and bushing 505 are shown at the top of lock plate 504 in the locked position where bushing 505 is contained in the narrow parallel sided portion of the shaped slot in lock plate 504 such that lock plate 504 is not free to rotate about point 313, thereby causing the chair to be in a locked position. As lock tube 506 is lowered, it can be seen that bushings 505 will then move into increasingly more open areas of the shaped slot in plates 504.

When tube 506 is at the bottom of its travel, lock plates 504 are free to move and the chair will be in the free and unlocked position. Conversely, when lock tube 504 is released from its lower and free position, that an upward spring force on tube 506 will cause tube 506 to move upward while also gradually allowing less and less movement of plate 504 and movement of chair until the full up and locked position is reached.

For clarity the view shown in FIG. 16*a* will be referred to as the left side (when viewed from the front). Accordingly, FIG. 16*b* will be referred to as the right side.

Figure 16B:
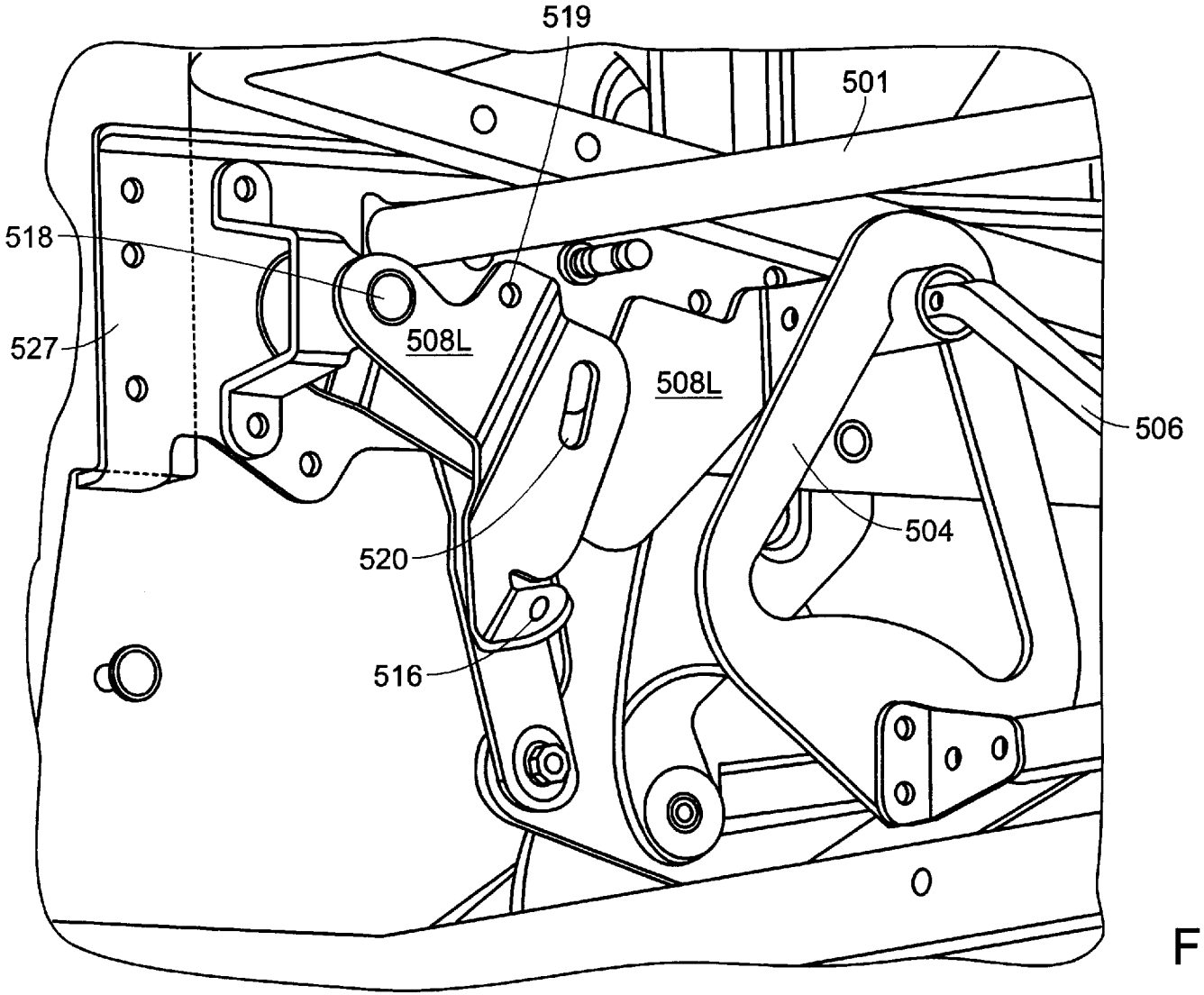

With reference to FIG. 16*b*, it can be seen that two components comprise the lock assembly on the left side, cam plate 510-L and lock arm 508-L. On the left side, where there is no brake lever 509, these components must function simply to allow arm 508-L to pivot about point 518 and to allow cam plate 510-L and its bushing (not shown) at point 519, which busing engages slot 500 behind cross tube 501, to urge slot member 500 upward as a result of the upward pull of a spring attached at point 516. Slot 520 serves to limit the travel of plate 510-L. The upward urging of slot 500 described here on the left side balances a corresponding upward urging of the slot on the right side so that the seat frame 503 and seat surface will be evenly supported and urged upward on both sides so that, without a seated occupant, the front of the seat will move slightly upward in slot 500 a distance equal to the difference between the diameter of tube 501 and the width of the slot 500.

Figure 16C:
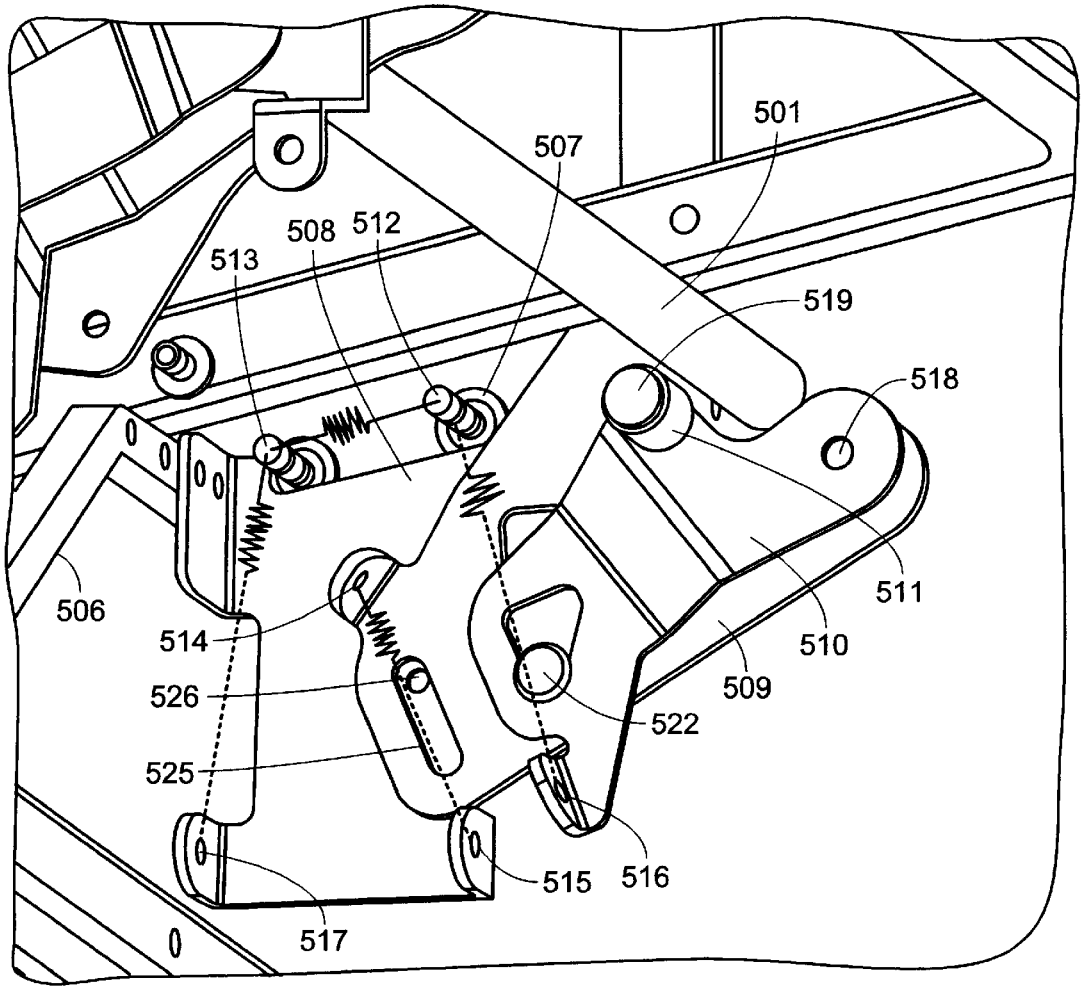
Figure 16D:
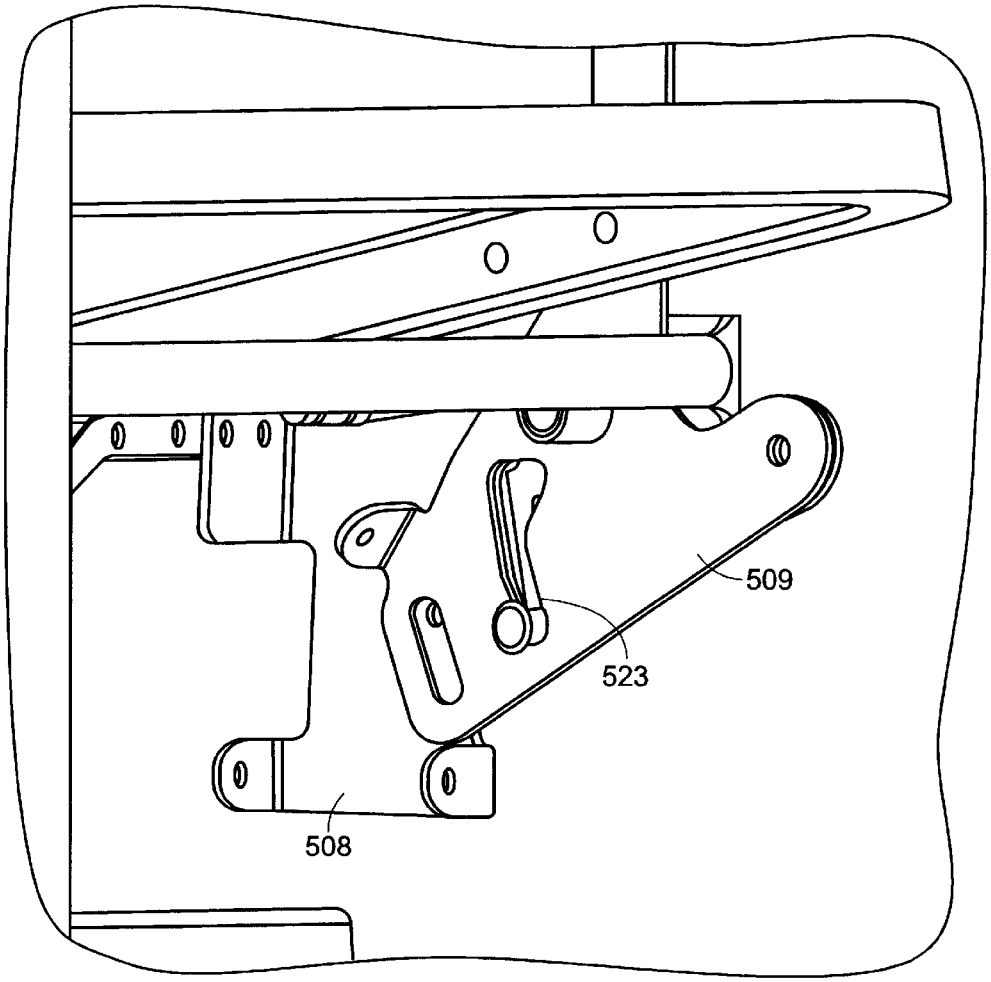
Figure 16E:
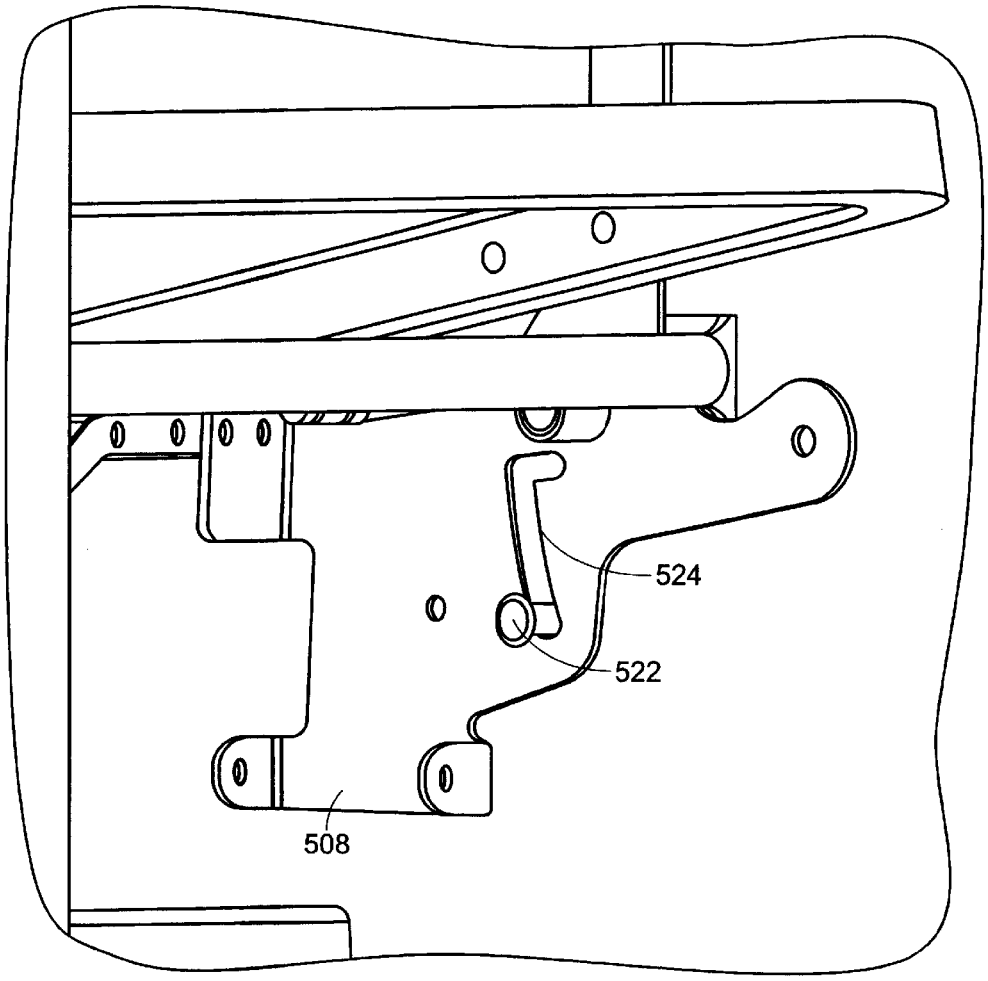

Now, looking at the right side as shown in FIGS. 16*c*, 16*d*, and 16*e*, brake lever 509 pivots about point 518. Likewise cam plate 510 and bushing 511, as well as brake arm 508 also pivot about point 518. Referring particularly to FIG. 16*e*, slot 524 allows pin 522 in link 507 to be engaged in the top portion of the slot such that lock arms 508 and lock tube 506 are latched in a downward and free, unlocked position. This latched or cocked position is attained by a spring pulling pin 512 at the top of link 507 to the rear that accordingly urges pin 522 forward and into the detent at the top of slot 524.

Referring to FIG. 16*c*, four components of the right side lock assembly are shown: link 507, brake arm 508, brake lever 509, and cam plate 510. Cam plate 510 is urged upward by a spring from hole 516 to pin 512. Lever 509 is urged downward relative to brake arm 508 with a spring from hole 515 to hole 514. The top of link 507 is urged backward by a spring from pin 512 to pin 513. Brake arm 508 is urged upward by a spring from hole 517 to pin 513. Springs used to urge bushings 511 upward and are sized to ensure that plates 510 and 510-L move upward and that the assembly returns to the locked position when the weight of the occupant is removed from the seat and, correspondingly, that said plates move downward when the occupant is seated.

Referring further FIG. 16*c*, slot 525 and a pin at hole 526 limit relative motion between members 508 and 509. It can be seen that by pulling the top of brake lever 509 backward, an occupant can move lock arms 508 and lock tube 506 downward to a free and unlocked position and that upon such downward movement, pin 522 will engage the detent of slot 524 and will then hold the seat in the free and unlocked position unless and until either brake lever 509 is pushed forward or cam plates 510 and 510-L move upward upon the occupant moving out of the seat. The upward movement of either lever 509 or plates 510 will cause the ramp edge on the upper section of shaped slots 523 and/or shaped slot 521 to push pin 522 out of the detent in slot 524, whereupon the invention will return to a centered and locked position.

The lock mechanism described with reference to FIGS. 16*a*–16*e* thus advantageously locks automatically whenever someone gets out of the chair, thereby ensuring that the chair will be in a stable unmoving position whenever someone gets into the chair. Further this mechanism requires the occupant to be seated in the chair and to consciously pull the brake lever 509 to its cocked and unlocked free position before the chair will move. This advantageously precludes any surprise or unintended motion or oscillation of the chair. This mechanism is preferably, but not necessarily, arranged to be self-centering so that when the chair locks it is returned to its intended and most aesthetically pleasing, balanced, and stable position unlike other known locks which randomly fix the chair at any of a number of positions and wherever the chair is in its path of motion when the lock is engaged. Further this mechanism functions without any detriment to, or friction being applied to, the oscillation of the chair in its free unlocked position.

While the invention has been described in detail, it is to be clearly understood that the same is by way of illustration and example and is not to be taken by way of limitation. Indeed, numerous variations and modifications will be apparent to those skilled in the art. All such variations and modifications are intended to be within the scope of the present invention as defined in the appended claims.

I claim:

1. An apparatus for imparting substantially oscillatory motion to a subject, the apparatus comprising:

a support assembly for supporting the subject, the support assembly capable of oscillation along a path of motion with respect to a fixed frame; and an oscillatory mechanism that defines the path of motion of the oscillating support assembly, the oscillatory mechanism including a linkage assembly for coupling the oscillating support assembly to the fixed frame, the linkage assembly comprising:

(i) a first link having first and second portions, the first link being coupled at a first point of the first portion to a translation mechanism attached to the oscillating support assembly, the translation mechanism arranged to allow the first point to reciprocate along a substantially straight line; the first link additionally coupled at a second point of the second portion to the fixed frame, and having a connection point disposed between the first and second portions of the first link; and (ii) a second link having a first and second portions, the second link being coupled at a first point of the first portion to a translation mechanism attached to the fixed frame, the translation mechanism arranged to allow the first point to reciprocate along a substantially straight line, the second link additionally coupled at a second point of the second portion to the oscillating support assembly, and having a connection point disposed between the first and second portions of the second link, wherein the connection point of the first link is pivotally coupled to the connection point of the second link in such a manner as to permit relative pivotal motion of the first link with respect to the second link about a pivot axis substantially perpendicular to the path of motion of the support assembly;

the first portion of the first link being offset with respect to the first portion of the second link in a direction transverse to the path of motion of the oscillating support assembly, and the second portion of the first link being offset with respect to the second portion of the second link in a direction transverse to the path of motion of the oscillating support assembly in such a manner as to allow at least one of the first point to the first link and the second point of the second link to pass through a plane transverse to the path of motion and containing the first point of the second link and the second point of the first link during the oscillation along the path of motion of the support assembly;

a third link having first and second portions, the third link being coupled at a first point of the first portion to a translation mechanism attached to the oscillating support assembly, the translation mechanism arranged to allow the first point to reciprocate along a substantially straight line, the first link additionally coupled at a second point of the second portion to the fixed frame, and having a connection point disposed between the first and second portions of the first link; and a fourth link having first and second portions, the fourth link being coupled at a first point of the first portion to a translation mechanism attached to the fixed frame, the translation mechanism arranged to allow the first point to reciprocate along a substantially straight line, the fourth link additionally coupled at a second point of the second portion to the oscillating support assembly, and having a connection point disposed between the first and second portions of the fourth link;

wherein the connection point of the third link is pivotally coupled to the connection point of the fourth link in such a manner as to permit relative pivotal motion of the third link with respect to the fourth link about a pivot axis substantially perpendicular to the path of motion of the support assembly, and the first portion of the third link being offset with respect to the first portion of the fourth link in a direction transverse to the path of motion of the oscillating support assembly, and the second portion of the third link being offset with respect to the second portion of the fourth link in a direction transverse to the path of motion of the oscillating support assembly in such a manner as to allow at least one of the first point of the third link and the second point of the fourth link to pass through a plane transverse to the path of motion and containing the first point of the fourth link and the second point of the third link during the oscillation along the path of motion of the support assembly.

2. The apparatus according to claim 1, further comprising a first crossmember coupled to the first portion of the first link and the first portion of the third link.

3. The apparatus according to claim 2, further comprising a second crossmember coupled to the second portion of the first link and the second portion of the third link.

4. The apparatus according to claim 1, further comprising a second crossmember coupled to the second portion of the first link and the second portion of the third link.

5. The apparatus according to claims 1–4, further comprising an actuator permitting the subject while supported by the support assembly to apply a non-gravitational acceleration to the support assembly.

6. The apparatus according to claim 5, wherein the actuator includes a manipulandum having a curved profile protruding through an opening.

7. The apparatus according to claim 6, wherein the manipulandum is a disc-shaped member.

8. The apparatus according to claim 7, wherein the member includes an arcuate perimeter of approximately 180 degrees and the remainder of the perimeter is a chord corresponding approximately to a diameter of the disc.

9. The apparatus according to claim 5, wherein the actuator includes a manipulandum having a curved profile.

10. The apparatus according to claim 5, wherein the actuator includes a manipulandum having an arcuate profile and wherein the opening is a slot.

11. The apparatus according to claim 5, wherein the actuator is coupled by a linkage to the oscillatory mechanism.

12. The apparatus according to claim 1, wherein the first link is disposed so that the first connection point is located approximately collinearly with the first and second points of the first link.

13. The apparatus according to claim 1, wherein the links include flat members having substantial width in at least one plane transverse to the pivot axis.

14. The apparatus according to claims 1–4, further comprising a lock mechanism having a first position to preclude motion of the oscillatory mechanism and a second position to permit motion of the oscillatory mechanism, the lock mechanism biased to assume the first position in the absence of a substantial weight present on the support assembly.

15. The apparatus according to claim 14, wherein the lock mechanism is configured to assume the second position only in the presence of a substantial weight on the support assembly and only if a manual release has been activated.

* * * * *